US005492290A

United States Patent [19]

Quinn et al.

[11] Patent Number: 5,492,290

[45] Date of Patent: Feb. 20, 1996

[54] MODEL RAILROAD OPERATION USING PROXIMITY SELECTION

[75] Inventors: Patrick A. Quinn, Aloha; Frederick E. Severson, Beaverton, both of Oreg.

[73] Assignee: QS Industries, Inc., Hillsboro, Oreg.

[21] Appl. No.: 331,109

[22] Filed: Oct. 28, 1994

[51] Int. Cl.[6] ..... B61L 11/00

[52] U.S. Cl. ..... 246/219; 246/220; 246/246

[58] Field of Search ..... 246/219, 220, 246/246, 253, 256, 277, 314, 326, 473, 132, 133, 270 R, 415 A, 218; 104/295, 301, 303

[56] References Cited

U.S. PATENT DOCUMENTS

| | | | |
|---|---|---|---|
| 1,798,171 | 3/1931 | Rosenthal | 246/415 A |
| 1,891,059 | 12/1932 | Rosenthal | 246/415 A |
| 1,911,243 | 3/1933 | Rosenthal | 246/415 A |
| 2,691,093 | 10/1954 | Chu | 246/219 |
| 2,880,308 | 3/1959 | Tsiang | 246/219 |
| 3,145,958 | 8/1964 | Dasburg et al. | 246/219 |
| 3,219,815 | 11/1965 | Albertson et al. | 246/415 A |
| 3,361,906 | 1/1968 | Guthrie | 246/220 |
| 3,553,667 | 1/1971 | Munzberg | 246/415 A |
| 3,963,203 | 6/1976 | Pascoe | 246/219 |
| 4,223,857 | 9/1980 | Hussein | 246/415 A |
| 5,050,823 | 9/1991 | Parker | 246/219 |
| 5,085,148 | 2/1992 | Konno | 246/415 A |
| 5,226,619 | 7/1993 | Alger | 246/219 |

FOREIGN PATENT DOCUMENTS

| | | | |
|---|---|---|---|
| 3136971 | 6/1991 | Japan | 246/219 |

*Primary Examiner*—Mark T. Le
*Attorney, Agent, or Firm*—Marger, Johnson, McCollom & Stolowitz

[57] ABSTRACT

An electronic control system for model railroads incorporates electronics which "arms" all railroad track switch turn-outs (here after referred to as "turn-outs") at once, selects and toggles the state of a specific turnout by the approach of a model train directly after arming, and "disarms" all the turnouts at once when the selected turnout has operated. A variation of this method is also applied to model railroad electric uncoupler track sections or automatic unloader track sections to arm, select, operate and then disarm any desired track section.

16 Claims, 12 Drawing Sheets

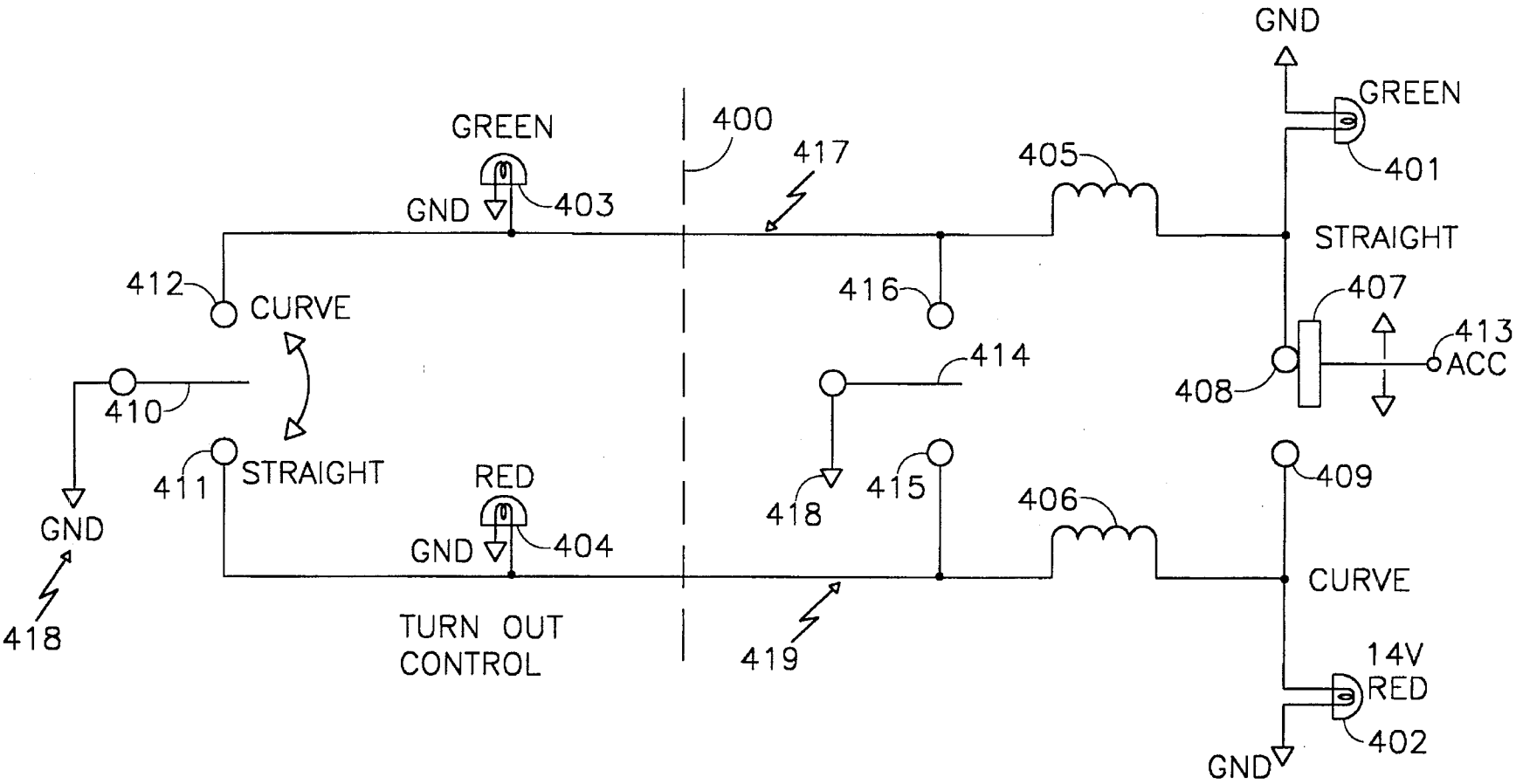
FIG. 4 CONVENTIONAL TURN-OUT
PRIOR ART

MODEL RAILROAD OPERATION USING PROXIMITY SELECTION

FIELD OF THE INVENTION

This invention relates to an electronic control system and in particular to the remote control of special track sections such as switch turn-outs, uncoupler and unloader sections, highway crossing gates, etc. on model railroad layouts.

BACKGROUND OF THE INVENTION

From the beginning of prototype (actual commercial) and model railroading, an operator has moved his locomotive around a fixed layout of track, choosing various alternative routes through the use of a turn-out, see FIG. 1. A detail drawing of a turn-out is show in FIG. 2. This turn-out consists of a lead-in leg, 203, a straight tangent leg, 201, and a curved divergent leg, 202. The three legs will be referred to hereafter as lead in, straight and curve. There are two track rails held at a fixed distance apart called the switch points, 204; on model railroads this is sometimes called a "swivel" piece. The switch points are moved from side to side by the throwbar, 205, which moves the curved closure rail, 208, against the top rail, 206, (straight position) or the straight closure rail, 209 against the bottom rail, 207. When the switch points are in its "straight" position, a locomotive entering the lead-in portion of the switch, 203, is directed to proceed in a straight path through the straight leg, 201, of the turn-out. When the switch points, 204, are in the "curved" position, a locomotive entering the lead-in portion of the switch is directed to proceed in a curved path through the curved leg, 202, of the turn-out.

The frog, 210, is flat metal area that supports the train wheels on the wheel rims as it runs through the area where the curved and straight closure rails end at the toe of frog, 211. In order to prevent the train wheels from slipping laterally through the frog area, guard rails, 212 or 213, are added to restrain the opposite wheel and keep the train on track. Turn-outs are produced as "right" or "left" hand types; the turn-out shown in FIG. 2 is a right handed turn-out.

A prototype turnout moves the switch points by actually bending the rails slightly as the throwbar, 205, is moved back and forth. The closure rails, 208 and 209, are attached at the frog toe position, 211. In model railroads, the switch points, 204, are often part of a fixed metal swivel that is pivoted near the toe of the frog, 211. This eliminates the added force to flex the closure rails as the throwbar is moved back and forth.

For either model railroads or prototype railroads, early designs of turnouts required that the switch points be moved by hand. Today, in most modem prototype rail yards and on many model railroads, the switch points, 204, are operated by remote control using pneumatic or electric motors or solenoids. On model railroads, these are called automatic or remote control turnouts. Typically, on model railroads, all of the remote control turn-out controls are routed back to a common layout control center, 120 in FIG. 1 which also has the power control transformer 112 for the powered track and layout accessories. Early model railroad turn-out designs would cause a derailment if the train entered through the curved or straight leg of a turnout that was switched in the opposite direction. For three-rail AC layouts, a "non-derailing" turn-out was introduced around 1950 which automatically detects a train entering the curved or the straight leg of a turn-out and toggles the switch points to the direction required; this allows a train to enter a turn-out from either the straight or curved leg without the operator having to specifically set the switch points. These non-derailing detectors can provide useful information for our invention on how a turn-out is occupied.

With remote control turn-outs, an operator can sit at his layout control center, 120 in FIG. 7, and by selecting which way each turn-out is set (straight or curve), he can direct his train anywhere around the layout he wishes. Thus, a turn-out is selected by operating the appropriate control lever, 701 through 704, which is connected to that specific turn-out. Operation of the selected turn-out occurs by moving the lever to either the "straight" position (often confirmed by lighting a green light) or to the "curve" position (often confirmed by lighting a red light). The movement of this control lever then operates the solenoid or motor, moving the throwbar, 205, to the desired position.

With the advent of various radio-controlled and tethered electronic locomotive throttles and layout controllers, the operator is no longer constrained to operate his turn-outs from the layout control center, 120. Because a hand-held controller has limited room for buttons and levers, other methods are used to select a turn-out or other accessory. One technique assigns identifying numbers to each remote control turn-out; the operator selects the desired turn-out by entering the identifying number (usually on a simple keypad) and pressing an additional button to activate the specific turn-out. Thus, while the operator has mobility and a single common controller, there is no substantial change in the method used to select and operate the turn-outs.

There are two methods for using identifying numbers for each turn-out. The first utilizes identifying numbers for each turn-out lever controller at a layout control center, 120, where each lever is connected to each specific turn-out. The second method uses electronics in each turn-out to hold the identifying numbers in local memory or using a group of toggle switches or program jumpers that are set by the user in each turn-out. The second method of using identifying numbers in the turn-out allows turn-outs to be selected and operated from direct transmission or from signals introduced onto the model railroad track or a common bus that connects to all turn-outs. The second method also eliminates much of the wiring between the turn-outs and a layout control center. Still, there is no substantial change in the method used to select and operate the remote control turn-outs; each turn-out must be selected by locating its specific control lever or finding and entering its unique identifying number. For most layouts this is a tedious task; the operator is diverted from watching his model trains and instead has to deal with turn-out identification. Since the operator is also involved in operating the train throttle plus a number of other tasks, this method of changing the turn-out position takes away from the joy of model railroading.

SUMMARY OF THE INVENTION

In accordance with the present invention, a turn-out control system has been developed which eliminates the need to explicitly select and operate turn-outs in the conventional way. It is possible to operate the turn-outs on the layout in a much more natural way which will eliminate the need to deal with each turn-out control in a specific way. Typically, an operator makes the decision that a turn-out is pointing the "wrong" way (for the direction he wishes the train to proceed) as he approaches the switch in question from the lead-in side, 203. This is true because this is when the decision is usually made as to which way he will direct his train. Thus, the selection of which turn-out to operate can be determined if there were means associated with each turn-out for determining that a train is approaching the lead-in side. With all the turn-outs on the layout so equipped, it is then possible to change the state of the turn-out directly in front of the moving train. This is done by communicating to all of the layout turn-outs at once that at this particular moment, you wish to "ARM" (i.e. prepare for toggling the switch points) all of the turn-outs on the layout. The one which will actually toggle is determined by the first turn-out to have a train approach it from the lead-in side.

Thus, only the turn-out directly in front of the approaching train can be selected to change its setting. If the operator does not wish to change the turn-out setting, he does not press the ARM control. If he does wish to change the turn-out setting, he presses the ARM control as the moving train is approaching this particular turn-out's lead in leg. In this way, the turn-outs on the layout will be set to direct the train in any way he wishes. It is almost like "think and drive" in that the tedious task of locating the control of each particular turn-out has been replaced by a single ARM operation and letting the approaching train select and operate the desired turn-out.

One additional aspect of this invention is to prevent a turn-out that is already occupied from ARMING and operating when the ARM signal is activated. If an occupied turn-out becomes ARMED, it may toggle (or operate) as the train cars are being pulled over the turn-out since the detector in the lead-in leg of the turn-out might perceive each train car as a "approaching train"; this would cause a derailment of the train. Hence, all turn-outs that are "already" occupied must not be allowed to ARM.

Once the turn-out directly in front of the approaching train has toggled its direction, it is crucial that all of the turn-outs on the layout now be DISARMED. Otherwise, the next turn-out in line would still be armed for the approaching train, which may not be what the operator wants. Like the ARM signal, the DISARM signal is common to all the turn-out on the layout. Through clever design, it is possible to use the same single, common control line for both ARM and DISARM.

The specific method used to implement this invention is less important than the concepts of: 1) detection of an approaching train at each turn-out, 2) occupancy of a turn-out by a train 3) common ARMING of all the turn-outs, and 4) common DISARMING of all the turn-outs after the selected turn-out has operated. "Common" is taken here to mean "essentially all at the same time." Thus, a set of turn-outs that are ARMED and/or DISARMED at once in response to a single arm or disarm signal would be said to do so in "common". Turn-outs armed in rapid sequence but essentially the same moment would also be described as being armed in "common".

Some examples of ways to do this "common" signaling are: wires, radio signals, coded engine horn signals (i.e. horn signals applied by the operator that have a specific sequence or timing applied to the track), light transmission, sound transmission, any specifically defined set or sequence of events, remote-control signals, or conditions, etc. This new turn-out control system is easily interfaced to "digital-down-the-track" command control systems by providing an interface to the turn-out arming circuitry from a command-control accessory output. An even more direct interface would be for a manufacturer to include an explicit "turn-out arm control" on their walk-around controller and to provide electronics in the turn-outs that will respond directly to an ARM command sent digitally down the track or a common bus that connects all turn-outs.

The feature of this invention for turn-out control also can provide information on train direction. If there are detectors also located in the curve and straight legs of the turn-out, it is possible to determine when the train enters either the curved or the straight leg. The train is, of course, also detected at the lead-in leg detector of the turn-out. This is enough information to determine the direction of the train as it passes through the turn-out.

UNCOUPLER TRACK SECTIONS:

A "turn-out" is a special type of track section. Another special type of track section used on many three-rail O'gauge layouts is one called an "uncoupler track." The uncoupler track shown in FIG. 3 is a piece of track section, 300 that has an electromagnet, 301 centered between the rails. The electromagnet is activated by a single pole-single-throw button, 302, that connects to a power supply through line 303.; the return path for the electromagnet current is usually through the track outside common rail, 304, which is connected directly to the layout power supply. This type of track works with model railroad cars that are equipped with special type couplers that have an attached ferromagnetic armature that can be pulled down by a magnetic field. FIG. 9 shows a common three-rail O'gauge railroad truck, 901, equipped with an automatic magnetic uncoupler mechanism. Part of the truck side-frame, 911, has been removed to show the coupler pin, 902, the pull down armature, 903, and the coupler knuckle, 904. The armature, 903, is pivoted at 905. In this drawing, the armature is shown in the pulled down position; it is usually held in the up position by a return spring 906. Also shown in FIG. 9 is a cross section drawing of the electromagnet, 907, in the uncoupling track. The ferromagnetic core, 908 is shown surrounded with the solenoid wires 909 and 910 shown in cross section. If the electromagnet on the uncoupler track, 907, is energized and a car with properly equipped automatic couplers rolls over the magnet area, the coupler armature, 903, will pull down and the pin, 902, will release the coupler knuckle, 904, to open. After the electromagnet, 907, is turned off, or the truck moves away from the electromagnet, the armature will return to the upper position. This will not close the coupler knuckle, 904; the knuckle is closed when another rail car truck coupler mates against it.

This same concept of selecting a specific turn-out by using the presence of the train directly in front of the turn-out can also be employed to select one specific uncoupler track out of many on a model train layout. The concept works as follows: To make it possible to perform an uncouple operation in a large variety of locations on the layout, the operator can insert many uncoupler tracks at strategic locations. In accordance with the present invention, one way the operator could select and operate the one and only uncoupler track he wanted, could be to "arm" (i.e.—make ready for operation) all of the uncoupler tracks at essentially the same time (in common.) Next, the uncoupler track that would, in fact, be selected would be the next one on the layout to become newly occupied by a train. As soon as the uncoupler track is occupied by the train, it sends a disarm signal to all other uncoupler tracks but does not disarm itself nor does it operate by itself. Instead the selected uncoupler track is operated (turning on the electromagnet) from a controller button at the layout control center or from a button on a walk-around throttle. After the selected coupler is activated, it too becomes disarmed. This method differs slightly from the turn-out selection and operation since the magnet on the uncoupler track section is not automatically energized as soon as it is occupied by the approaching train. If this were to happen, the first car that rolled over the uncoupler track section would be uncoupled from the train and this may not be the one the operator had in mind. The operator would prefer to wait for the specific car he wanted to uncouple to reach the uncoupler track section before the uncoupler track electromagnet was energized. Hence, this method allows the uncoupler track section to be selected by the approaching train but not operated until the operator presses a control button.

Another method to arm, select and operate a specific uncoupler track is as follows. The operator presses a single uncouple button on his layout or walk around throttle to arm all the uncoupler track sections. The first one to be newly occupied by the train remains selected which results in a signal to all other uncouple track sections to disarm. This is the same as described above. However, when the same button is pressed again, it will activate the selected uncoupler track section but will not arm the other couplers. After the uncoupler has fired, it will disarm the selected uncoupler track. The next time the coupler button is pressed it will again arm all unoccupied uncoupler track sections. This second method will allow arming, selection and operation to all be done from a single uncoupler button.

Sometimes an operator will miss his uncoupler operation because the car he wanted to uncoupler has already passed over the electromagnet when he presses the uncouple button. When this happens with normal uncoupler track sections that are operated with a dedicated button per uncoupler, see FIG. 3, he can simply stop his train and back up to where the uncoupler track section is lined up with the car coupler and press the uncoupler button. He can try and try again until he gets the desired results. However, with our invention as described above, it would be necessary for the entire train to back up so the uncoupler track section is no longer occupied, arm all the couplers and enter the uncoupler track section to try again.

To solve this problem, another variation could be used. Instead of disarming the selected uncoupler track section when the uncoupler is fired, the uncoupler track section would remain armed until specifically told to disarm with a separate user command. One solution would be to use a special coded signal using the single uncoupler button. For instance, the uncouple button could be held down for some minimum time, $t_{min}$, period (e.g. 3 seconds) which would disarm the selected uncoupler track section. In this way, any number of uncouple operations on the selected uncoupler track section would be allowed if each operation was less than the minimum time period, $t_{min}$. Now, if the user missed an uncouple operation with the selected uncoupler track section, he could stop his train, back up and uncouple the desired car with a second, third or any number of re-tries. After the operator successfully uncoupled the car, he could disarm the selected uncoupler track section by holding the uncoupler button down for longer than $t_{min}$.

Another possibility is to detect when an uncouple has occurred. Since it takes energy to pull down the armature, 903, against the return spring, 906, this could be detected by monitoring the current in the solenoid windings, 909, 910. Other methods of detection of a pulled down armature include interruption of a light beam, sound detection of the armature, 903, striking the core, 908 and change in the impedance of the solenoid inductance (since the presence of the pulled down armature adds to the core, 908, magnetic mass). Detection of an uncouple would also allow sound effects of a coupler being opened (along with air release from parting air brake lines) to be synchronized with the uncouple operation.

Another solution would be to include a separate arm/disarm button at the layout control center or on the walk-around throttle controller. When the arm/disarm button is pressed, all uncoupler track sections would be armed at the same time, only one would be selected by the approaching train and all other uncoupler track sections would disarm. However, the selected uncoupler track section could then remain armed and could be activated by the uncoupler operate button any number of times. The selected uncoupler track section would be disarmed by pressing the arm/disarm button a second time.

All of the above methods for selecting and arming an uncoupler track section require detection for the arming and selection process. However, unlike turn-outs, the arming and selection must occur if the train approaches from either side. FIG. 10 shows an uncoupler for three-rail track with additional special insulated track sections 1005 and 1006 on either side. An insulated track section is a common way to detect the presence of a train for three-rail layouts. Normally, on three rail track, the outside rails are electrically connected together over the entire layout. On insulated track sections, one of the outside rails is electrically isolated. In our example in FIG. 10, rails 1007 and 1008 are not electrically connected to the track rails 1001, 1002, 1003 or 304 but instead are connected to detectors, 1012 and 1013; power for the detectors is through power supply line, 1014 and the return line for the detector is connected to the common outside rail, 304. When the metal wheels of an engine or train car is on the insulated track section, the metal axle between wheels will electrically connect the two outside rails together which activates the detector. The outputs, 1015 and 1016 from the detectors, 1012 and 1013, could be connected to an "OR" gate to select the uncoupler track if a train approaches from either the right or the left. However, there may be advantages to keep the two detector outputs separated since it provides more detailed information on how the uncoupler track is occupied and also provides information on the train's direction.

Another variation to arm and select an uncoupler track section would be for the selected uncoupler to only disarm itself when it is no longer occupied. Thus, if the operator missed an uncouple operation, he could stop the train without leaving the uncoupler track section, back up to position the car over the electromagnet and try again and again. Only when the uncoupler track section become unoccupied would the selected uncoupler track section disarm itself. However, this method has a fundamental flaw. Once a car has been uncoupled from the train, it will stay in place and continue to occupy the track section. If this happens, the selected track section would not disarm itself and would prevent other uncoupler track sections from arming or operating; in other words, the selected uncoupler track section would simply fire over and over again each time the uncoupler button was pressed until the car was moved from the selected uncoupler track section. One way to solve this problem would be to use detectors on both sides of the uncoupler track as described above to allow the uncoupler to disarm when either side ceased to be occupied. As an example the outputs, 1015 and 1016, of the two detectors, 1012 and 1013, could be connected to an AND gate which would maintain a select signal only when both tracks, 1005 and 1006 are occupied. Now, when a car is uncoupled and the rest of the train pulls away only one of the track sections will be occupied resulting in the uncoupler section disarming. Also, considering that some cars coast when the train has been uncoupled, the two detector tracks, 1005 and 1006 may be better placed further from the uncoupler track section to ensure that one detector is unoccupied when the train pulls away from the newly-uncoupled car(s). Also, it may be an advantage to have a short (2–3 second) time delay before the decision is made about occupancy which will allow the train to pull away completely.

UNLOADER TRACK SECTIONS:

Another specialized track section for model railroading is called an unloader or operating track section. These track sections have extra rails to make electrical contact to sliding shoes on special operating cars to provide power to do some operation. For instance there are operating cars with tilting bins to unload coal or ore loads into track side trays, lumber cars with a tilting platform to throw logs to the side of the track, refrigerator cars that have a special mechanism to place model milk cans on a trackside platform, etc. The unloading track section usually has a dedicated control button to turn on the power to the extra rails; if an operating car is placed on the track, power is delivered to the car mechanism to operate the special feature.

Unloader track sections can be selected and operated in exactly the same way that uncoupler track sections are selected and operated. In this case, a special unloader button would be included on the walk-around throttle or at the layout control center to first arm all unloader track sections. The unloader track section would become selected when it becomes newly occupied by the train. Once the automatic car is placed over the unloader track section, the operator would press the unloader button which would operate the car and send a disarm all other unloader track sections. Once the train leaves the unloader track section, it disarms itself. Other methods similar to methods used on the uncoupler track section could be employed to keep the unloader track section selected for continued operation by the unloader button until the action was complete and then disarming.

Besides turn-outs, uncoupler track sections, and unloader track sections, there are other track or track-side animated or operating accessories that can use this invention for selection and operation. These include station announcement at model train passenger stations, highway crossing gates, hot box indicators, diesel fueling stations, sandloads, coaling stations, water stations, etc.

OCCUPANCY AND DETECTION:

For each of the uncoupler track, the unloader track section and the turn-out, the phrase "newly occupied" has been used. This phrase means that if a given special track section (a turn-out for instance) was already occupied (i.e. had a train sitting on it) at the time the common ARM signal was given, then this turn-out would be considered to be "previously" or "already" occupied at the time the ARM command was given. In the case of the turn-out, it is crucial that an already occupied turn-out not be armed. This is because operating an occupied turn-out will surely cause a derailment. A long train may be already occupying several turn-outs as it moves around the layout. Thus, when the common ARM command is given, none of the turn-outs that a train is already occupying can be allowed to arm themselves. Hence, the FIRST turn-out that the moving train will come upon next will become the SELECTED turn-out. In this way, the selected turn-out is always the next turn-out in front of the moving train.

There are a few practical issues about detection that also require a careful definition about the term "newly occupied". There are a number of ways to do train detection. If the layout uses three-rail track common to Lionel like layouts, a simple and commonly employed detection method is to insulate one of the outside rails and detect when the metal wheels and axles on the train shorts the two rail together. Another technique often used on two-rail layouts is to detect current flow from an engine on a separately powered track section. This technique is limited to engines or cars that require power from the track. Dummy engines (engines without motors) and most rolling stock do not require power and would not be detected. Another technique is to use optical detection. An optical source (e.g. IR or laser LED) can be placed over a optical-receiver to measure when the light beam is broken by a moving train and hence detect its presence. Other techniques may use motion proximity detectors or weight detection or sound or any number of other techniques. To date, most systems are flawed for some reason or another. The problem of detection is complicated by the variety of engines and rolling stock. Each car or engine is different is some way and may fail to trigger a detector. There is always a danger that some car may not be detected when an arm signal is generated. One way to deal with this problem is to allow a number of opportunities for detection by including a time period before a decision is made regarding occupancy. A moving train passing over a detector will provide a number of detection opportunities and if these are remembered for some time period, the chance of a false "non-detection" is reduced.

For this reason, "previously occupied" will also mean "has been occupied within the last few moments". "Few moments" may vary application to application—but, a value around 3 seconds appears to be appropriate for turn-outs on a model railroad. Thus, a train moving over an occupancy detector need not necessarily be occupied at that very instant of ARMING, but will be considered to be already occupied if the occupancy detector has indicated the presence of a train anytime within a specified previous time period.

At this particular time in history, a cost-effective and reliable method to detect the static (i.e., not moving) presence of a train is not apparent. thus, it is possible that one of the dynamic detector methods described herein would not know about the presence of a non-moving train straddling a detector. To avoid arming a turn-out that has a stationary strain straddling its occupancy detector(s) the operator is instructed to always move a train that has been stopped for more than 3 seconds to ensure that its presence on the turn-out will be detected before arming his turn-outs. Should good detectors become available which will detect every type of car or engine on every gauge of track in lighted and darkened rooms, etc. then this operating restriction can be eliminated.

Another point about detection is where the detector is placed. We have mentioned that track sections are selected by an approaching train. For non-derailing turn-outs, this means a detector is placed at the lead-in leg of the turn-out. Detectors do not absolutely have to be placed on the tangent leg or the divergent leg since non-derailing turn-outs already have detector built in to detect trains coming into the turn-out from these directions. In the case of uncoupling or unloading track sections, occupancy detectors need to be placed on both ends of the track section since a train can approach from either direction. It is important, however, to have the information that a train has entered a turn-out from either the tangent (straight) or divergent (curve) direction since it is possible for an operator to ARM the turn-outs just as his train is about to traverse a switch turn-out from either the curved or straight entrances. If this occurs, then this turn-out would also ARM and would toggle as the train reached the occupancy detector located near the lead-in leg of the turn-out. Upon toggling, the train on this turn-out would derail. It is desirable to include in this invention for turn-out control, facilities to deal successfully with this problem. For example, one might detect the presence of a train at all three legs of the turn out. If a train is detected at either of the curved or straight legs of the turn-out, then this turn-out would be DISARMED, and thus, prevented from toggling its setting when the train reached the lead-in detector. This local (or self) disarmament is not and does not produce a common global disarm signal.

The foregoing and other objects, features and advantages of the invention will become more readily apparent from the following detailed description of a preferred embodiment which proceeds with reference to the drawings.

BRIEF DESCRIPTION OF THE DRAWINGS

FIG. 4 is a wiring diagram of typical turn-out switch (prior art);

DETAILED DESCRIPTION OF THE PREFERRED EMBODIMENT

Figure 1:
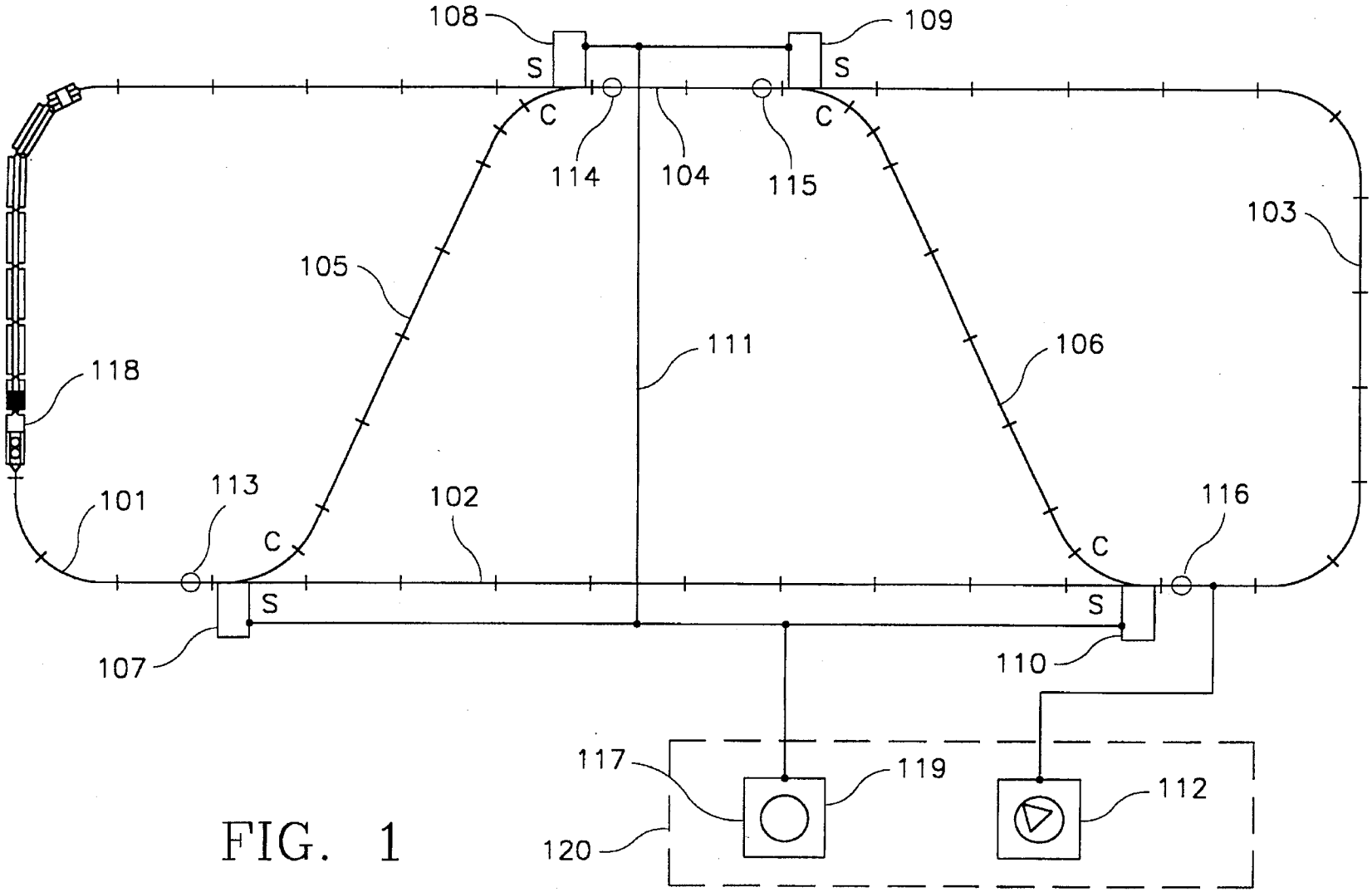
FIG. 1 is a layout diagram of the new turn-out control system.

FIG. 1 is a diagram depicting the elements of the present invention. This figure shows an outside loop of track comprising the standard track sections (not special track sections), 101, 102, 103, and 104. Also shown are four turn-outs, 107,108,109, and 110, each of which have a lead-in detectors 113,114,115, and 116. The curved and straight sections of each turn-out will be referred to as "S" for straight and "C" for curve. There a two additional sections of track on the layout, 105, and 106. These connect together the curved portions of turn-out, 107 and 108 and turn-out 109 and 110. The layout shown in FIG. 1 is an example of an endless number of ways that layouts containing turn-outs might be configured. The layout in FIG. 1 is complex enough to be useful in explaining the concepts, but should not be considered a limitation to the underlying concepts.

Figure 7:
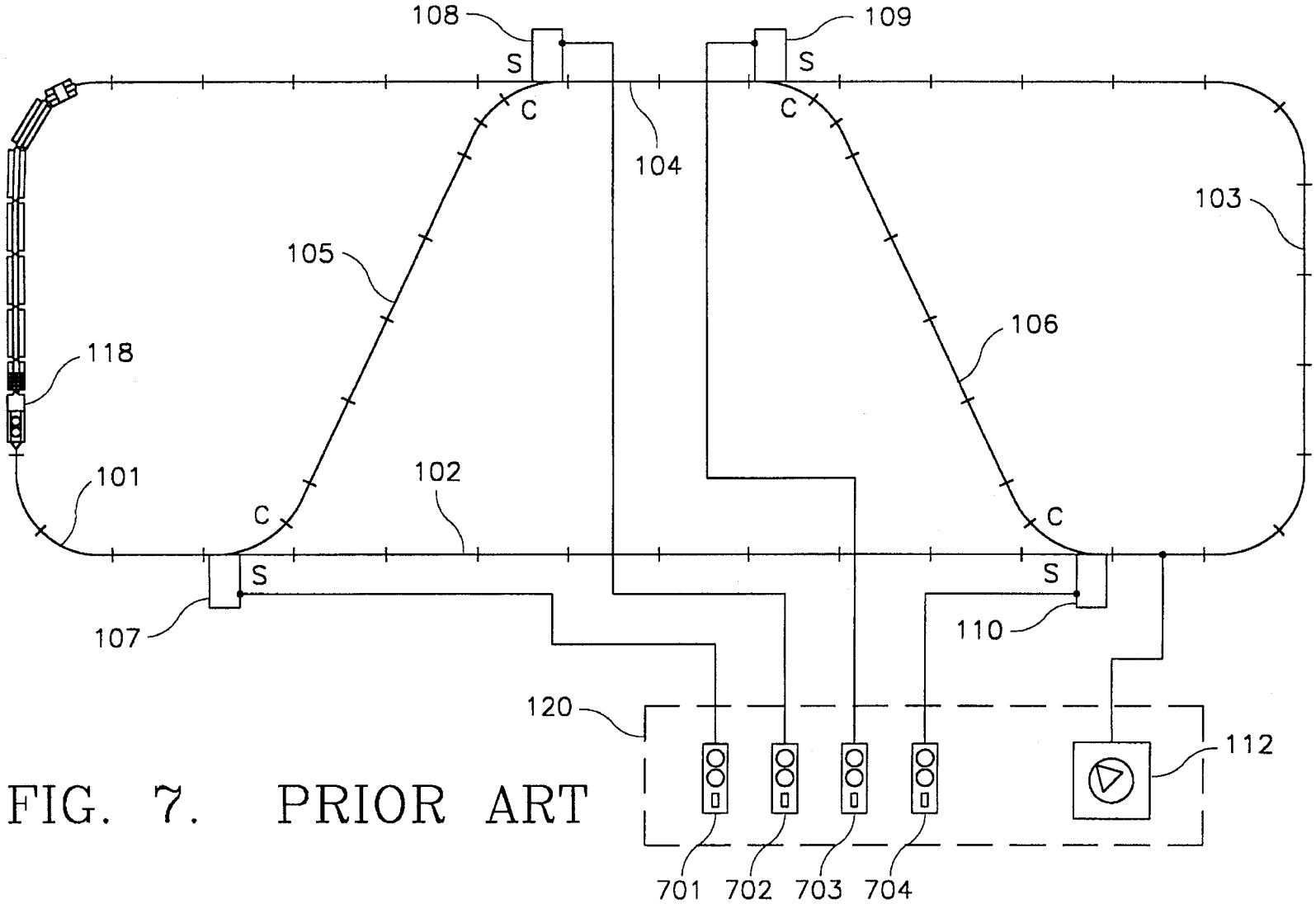
FIG. 7. PRIOR ART
FIG. 7 is a layout diagram of a conventional turn-out system (prior art);.

All of the six track sections, 101–106, are electrically connected and powered in the usual way by a track power supply, 112. All of the turn-outs shown in FIG. 1 are equipped with this invention and, as such, are tied together by control bus, 111, which contains one or more lines to affect the common ARM and DISARM operations. The "turn-out control", 117, connects to the common bus 111. Also contained in the common turn-out bus, 111, is the accessory turn-out power and its return line (for powering the turn-out switch machines and the electronics in each turn-out). The turn-out control, 117 and track power supply, 112 are located together at the layout control center, 120. FIG. 1 differs from most common layouts (FIG. 7, prior art) where each turn-out usually has its own control line coming to its own control unit. In FIG. 1 there is only one universal turn-out control, 117, and one common bus, 111.

Next, we will describe how a train might be moved around the layout if all turn-outs are of the conventional type which are operated in the conventional way by explicitly selecting the appropriate control for each specific turn-out. FIG. 1 is re-drawn as FIG. 7 with each turn-out, 107, 108, 109, and 110 connected to their own separate turn-out controllers 701, 702, 703, and 704 respectively. When the activator lever on any turn-out controller is moved to one direction or the other, the turn-out will switch between the straight or curved position. We will begin by assuming all of the turn-outs are set so that a train entering the lead-in side will go through to the straight side (i.e. all turn-outs are set to "S"). Also, assume that each turn-out is of the previously mentioned "non-derailing" type; that is, if a train should enter the turn-out through the C or S leg, the turn-out will automatically move the switch points to "C" or "S", as appropriate, to prevent a derailment.

Now, the train, 118, with engine and 5 cars and caboose located somewhere on track 101 and traveling in a counter-clockwise direction will pass through turn-out, 107, and proceed to track 102, through turn-out 110, to track 103, through turn-out 109, to track 104, through turn-out 108 and finally return to track 101. In this way, the train simply continues around the loop containing track sections 101,102, 103 and 104, in a counter-clockwise direction. This time, let us set turn-out 107 through turn-out controller 701, to C (instead of S). Now as the train enters the lead-in leg of turn-out 107, it will pass onto track section 105 (instead of 102). The train will enter turn-out 108 through its curved leg which would normally cause a derailment. However, all turn-outs on this layout are non-derailing type and turn-out 108 will automatically flip to C as the train enters. Thus, the train will proceed smoothly to track section 104. When it enters the lead-in leg of turn-out 109, the train will proceed to track section 103 since turn-out 109 is set to S. Upon entering turn-out 110, the train will proceed to track section 102. Now the train enters turn-out 107 through the straight leg. Remember we had previously set turn-out 107 to C. Because turn-out 107 is non-derailing, it will automatically switch to S and the train will pass smoothly onto track section 101. Likewise, when the train enters turn-out 108 from the straight leg, it will automatically switch to S and the train will proceed to track section 104. At this point, all the turn-outs are again set to S and the train is running in a loop through track sections 101, 104, 103, 102 in a clockwise direction.

Anytime the operator wants to return the train to moving around the loop defined by 101, 102, 103, and 104, in a counter-clockwise direction, he simply sets turn-out 110 from turn-out controller 704, to C. This will divert the train to track section 106, and in a similar way to what occurred in moving from counter-clockwise to clockwise the train will exit the curved leg of turn-out 110 onto track section 106, through turn-out 109 onto track section 104, through turn-out 108, onto track section 101, enter the straight leg of turn-out 107, to track section 102, enter the straight leg of turn-out 110, back onto track section 103—and the train is again running counter-clockwise and all of the turn-outs are set to S. As can be seen, the operator has complete control of where he wants to run his train on this layout. The turn-outs must be explicitly selected by reaching for the corresponding turn-out control and then explicitly operate the turn-out to set it to the desired direction at the appropriate time. For very complex layouts there could be many turn-out controls to locate (select) and then operate.

New Control Method

Let us now describe the same operations of running in a counter-clockwise loop, reversing to a clockwise loop and then returning to a counter-clockwise loop, but this time we will do it employing the concepts in this invention as shown in FIG. 1. Turn-outs that work in this new fashion will be called Proximity-Selected (PS).

As before, the train begins with all of the turn-outs set to S and the train running around the loop defined by track section 101, 102, 103 and 104, in a counterclockwise direction. We want to set turn-out 107 to the C direction to affect a loop reversal. Before the train gets to occupancy detector 113, we press a single common ARM control, 119, on turn-out controller and power supply, 117. This ARM signal is sent out to all of the turn-outs at the same time over control bus 111. At this point all of the turn-outs will be armed unless they are "already occupied" as previously defined. Thus, if the train were very long and reached back over 108 and even 109 as it was approaching detector 113, then turn-outs 108 and 109 would not arm since they would be already occupied. But, turn-outs 107 and 110 would arm (assuming the train was not so long that it also occupied these turn-outs as well). Since the next detector to become occupied after arming is 113, turn-out 107 will toggle from its previous setting (S) to its new setting (C) as the train rolls over occupancy detector 113. In addition to toggling turn-out 107, the control electronics for the common bus, 111, will inform all the other turn-outs on the layout that all turn-outs (including 107) should now disarm. This signal can be carried over bus 111, either on a separate DISARM line or multiplexed in some fashion onto a single ARM/DISARM line. It is, as previously mentioned, also possible to do this common signaling through any communication means one desires (ultra-sonic, modifying the room lighting, radio frequencies, digital-down-the-track, talking first back to the common turn-out control panel and having it relay the message to the rest of the turn-outs, etc.). Now, as before, the train will proceed to track section 105 and through the non-derailing feature of the turn-outs it will proceed to track sections 104, 103, 102, 101 and back to 104 and will now be traveling in a clockwise direction with all of the turn-outs again set to S.

To affect the return to running the train in a counter-clockwise direction, we can as before, set turn-out 110 to C. With the new control system, this is done by pressing the same single common ARM control, 119, on turn-out controller and power supply, 117, as train 118 approaches detector 116 but after it has passed 109. Thus armed, turn-out 110 will toggle from S to C when the train reaches occupancy detector 116. Now the train will proceed through track sections 106, 104, 101,102, 103 and back to 104 and will again be running around the outside loop of track in the counterclockwise direction and all of the turn-outs will be in the S position. Hence, this invention allowed the user to activate any desired turn-out from a single control button, 119, but instead of having to locate a controller for each turn-out, the operator lets the train select and operate the turn-out. Now the operator can run his train without taking his eyes off his train and layout and can remain enthralled with his miniature world without the distraction of having to search his control area for the correct switch lever to activate.

Block Systems

Figure 8:
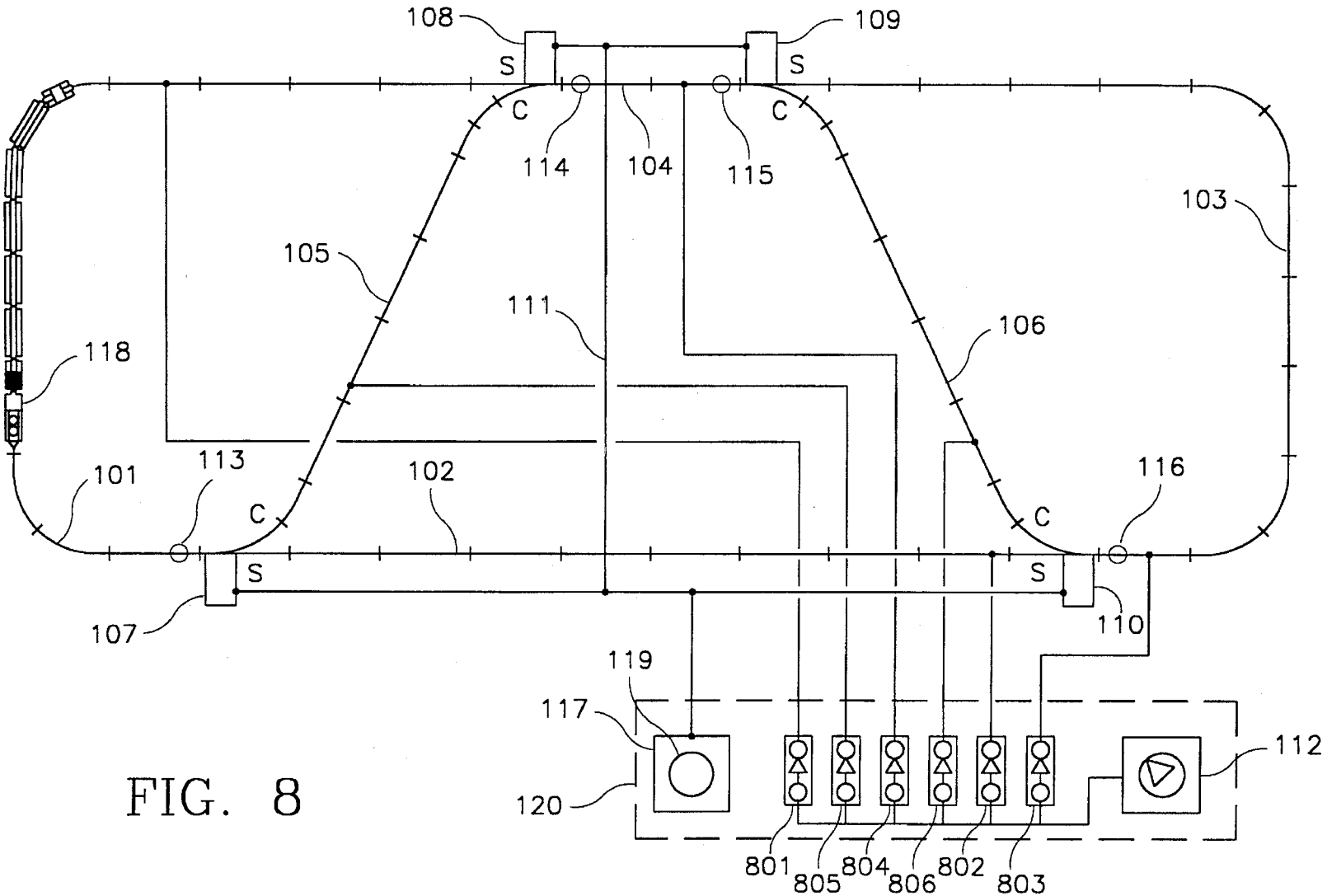
FIG. 8 is a layout diagram of a conventional block control system with turn-outs (prior art);.
Figure 9:
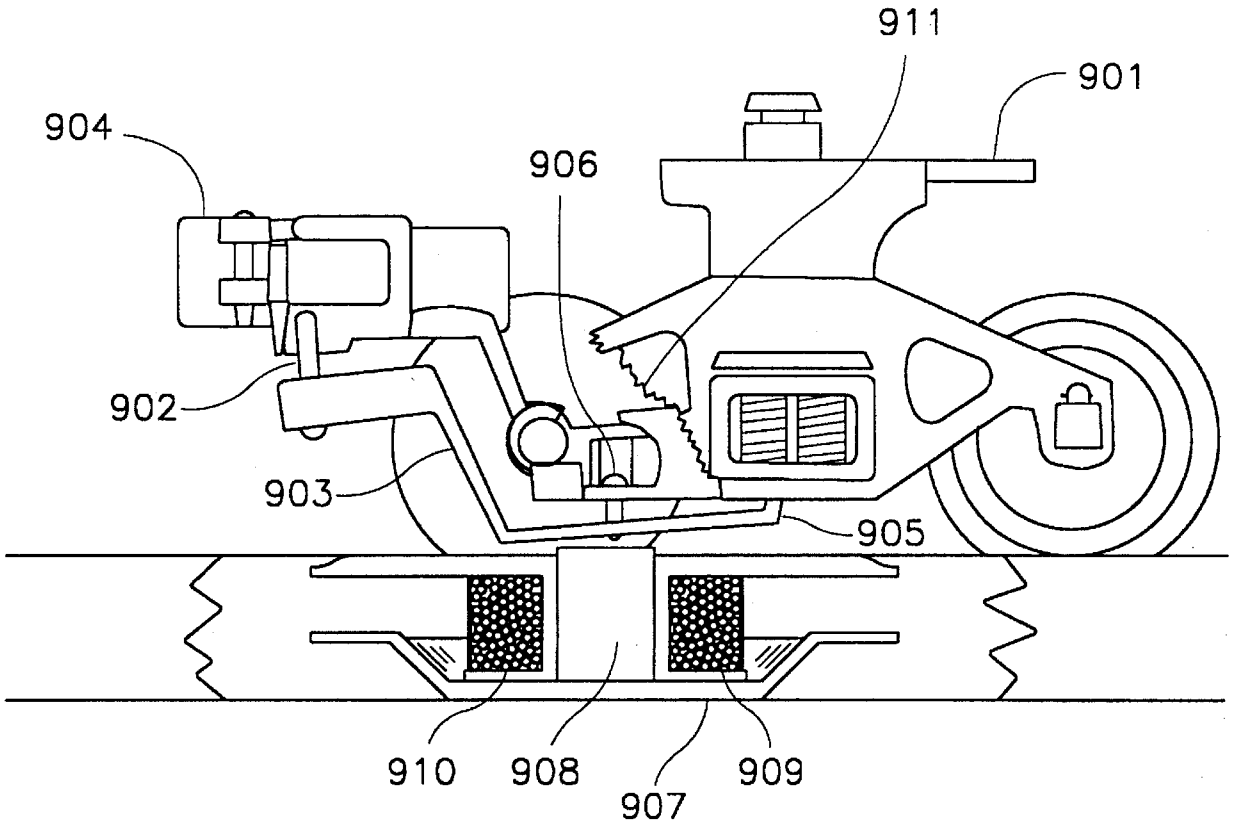
FIG. 9 PRIOR ART
FIG. 9 is a cross section of a Lionel automatic coupler, truck, and uncoupler track (prior art);.
Figure 10:
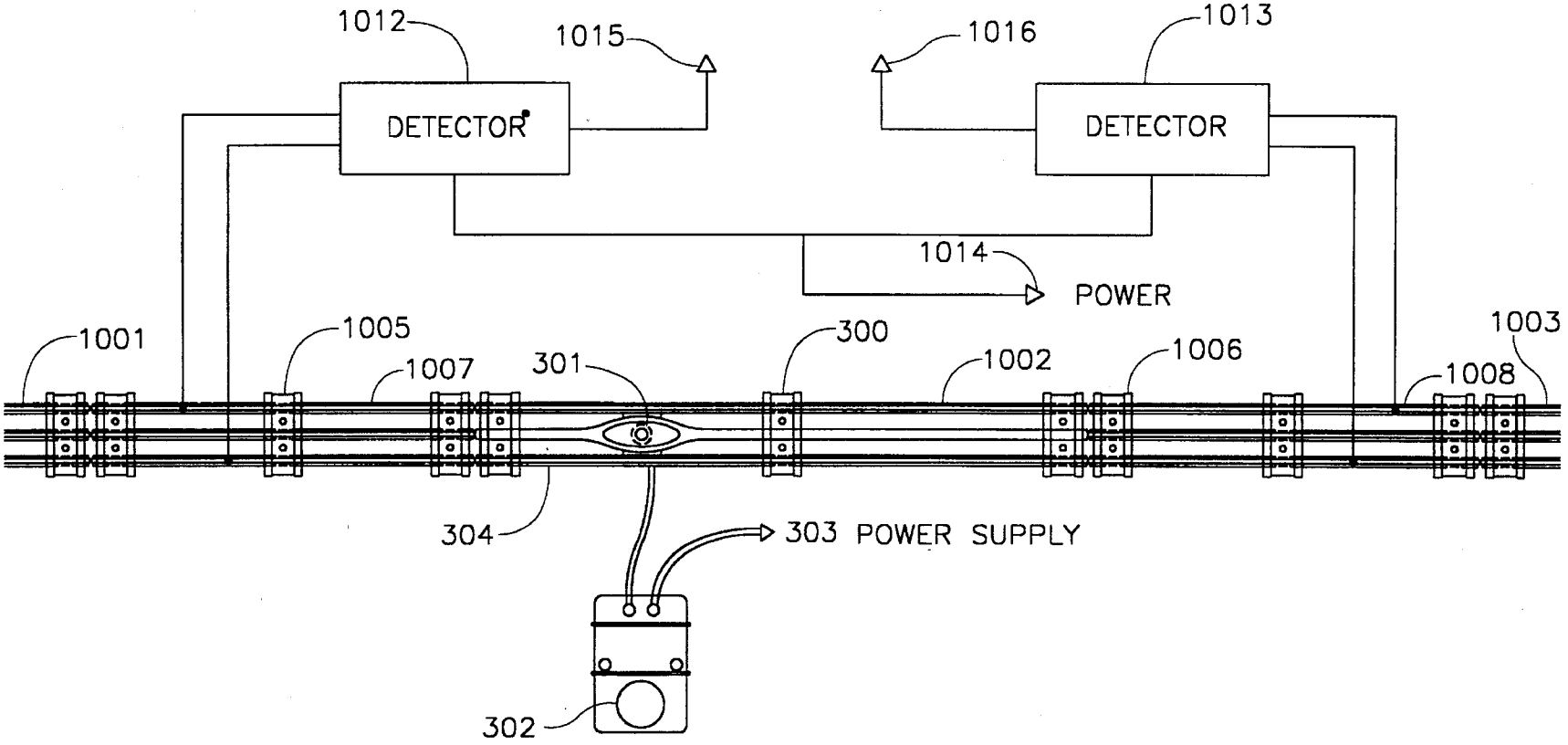
FIG. 10 is an uncoupler track section utilizing the preferred embodiment.

The layouts shown (in FIGS. 1 and 7) are called "single-block" power grids. By this, it is meant that all of the sections of track 101 through 106 are powered by a single power supply, 112. It is not uncommon for operators to divide the power to their layouts by running various blocks through switches before they come to a power source. FIG. 8 shows the same layout as FIG. 1 and FIG. 7 except that each track section, 101, 102, 103, 104, 105, 106 are electrically isolated from each other and each are connect to the power source through single-pole single-throw block switches 801,802, 803, 804, 805 and 806 respectively which are all connected to the common power supply, 112. Each of the track sections, 101 through 106 will now be referred to as blocks. With this configuration, an operator can actually power up only the section(s), or blocks, he wishes to power. It is anticipated that, should an operator place his layout under a multiple-block power grid that the proximity-selected (PS) turn-outs described in this patent would participate in this multiple-block configuration. If a turn-out is considered to be associated with the block that is connected to the lead-in side of the turn-out, then turn-out 107 would be part of track section 101, turn-outs 108 and 109 would be part of section 104, turn-out 110 would be part of track section 103. No turn-outs would be associated with blocks 106, 102 and 105. By "associated", we mean that if a block is turned off by the operator, then the track on the turn-out associated with that block would also be turned off; however, the detectors and their communication with the common bus, 111, would remain active. Hence, it is possible to arm PS turn-outs that are associated with unpowered blocks. Since there would be no power on that block, the only way to operate such a turn-out would be to back a long train into the PS switch on the unpowered block. This is not an uncommon practice and the turn-outs need to be active to prevent derailments and to allow switching the turn-out.

On multiple-block layouts, it is typical to have more than one block powered at the same time. It is possible, even likely, that there might be separate power sources powering separate blocks. It is basically having two (or more) operators using different parts of one large layout at the same time. In this case, operator 1 might use power grid 1 and operator 2 might use power grid 2. Clearly, operator 1 would not want his PS turn-out grid to interact with operator 2 and visa versa. Thus, in multiple-powered, multi-block layouts, it is desirable to have a method to either separate out the PS grid into separate control groups that correspond to each power supply, or to arrange to have the PS turn-outs within every block (or block group) assignable to the throttle and operator in control of that block or block group.

One special form of block control is one that divides a large layout into many small blocks and then, rather than turning on a fixed group of blocks and limiting the operator's sphere of control to that group, instead employs what is called a "moving block" (also called "follow-along block") system. In a moving block system, the idea is to recognize the extent of track sections that your train occupies and turn on only enough track blocks in front and behind your train to allow it to proceed under the control of one designated operator's power supply to the exclusion of the others. If only a single user is operating a moving-block system, the control of the PS turn-out grid is obvious—just assign the PS turn-outs to the active block whenever the turn-out is powered. However, a moving-block system is principally intended for multiple-user and multiple-power-control. So, as was described for the multiple-user fixed-block PS grid system, special measures must be taken here. The PS turn-outs involved in each powered block section must recognize, not just that they are "on", but also which operator they are assigned to. In this way, PS turn-outs can easily be turned on and off as they participate in some particular operator's moving-block, and the control of the common ARM signals for all the turn-outs within that particular operators moving block will come from that particular operator and cannot be controlled by any other operator's arm signal.

All moving block systems that have been designed to date have always employed a central control method. That is, each block brings back information regarding occupancy on that block and the power line for that block to a central processing location on the layout. It is at this central processing location that all decisions are made as to whether to turn on a given block and to whom it should be assigned. In such a system, we recommend that the PS turn-out control likewise be centrally located. It is possible to design a moving-block system in a different way—with distributed processing. That is, each block could contain the processing intelligence to make the decision locally as to whether it should be on and to which operator's power supply it should be assigned. In this case, each block needs to answer six questions: am I occupied and by whom?, is the block to my one side occupied and by whom?, is the block to my other side occupied and by whom? "By whom" here refers to which operator is in control of that block. For example, the block to the right might have a train on it and its power may be assigned to operator A. On the other hand, the block to the left may be un- occupied and yet its power may still be assigned to operator B (a result of operator B having a train approaching this block even further to the left).

And the block in question may be un-occupied and its power may be assigned to "off". From gathering in the answers to these six questions, each block section could make the decision locally as to whether it should assign its power and its PS turn-outs to be the same as the block to its left, or whether it should assign its power and its PS turn-outs to be the same as the block to its right, or whether it should assign its power and its PS turn-outs to be "off". There are additional issues having to do with the exact methods to be employed in initializing such a "distributed" moving-block control system so that trains newly put onto a distributed moving-block control system would know which operator (and therefore power throttle and PS turn-out control) this new block should be assigned to. These issues are best dealt with in a separate specification. At this point, it is important to point out that in a distributed moving-block control system the control of the PS turn-outs will also be distributed—that is, located locally where the occupancy issues are actually occurring and their assignment will follow the assignment of power to a particular operator.

One very convenient aspect of this invention is that it makes using large numbers of switch turn-outs easy and natural to control. Further, the PS turn-outs make ideal locations for boundaries of blocks in a multiple-block control system and "moving block" or "follow-along" block system since the PS turn-outs could contain electronics to control the local or "distributed" moving blocks.

Other Applications And Considerations

It is possible to apply the preferred embodiment to any model railroad gauge (even though most of the examples shown describe a three-rail application). In some cases the exact appearance of a turn-out, an occupancy detector or other aspect may vary, but the underlying concepts can still readily be applied. It is possible to apply this invention to the design of a slot-car (or slot-car like) automotive toy raceway set. In this case the exact route that a toy race car operator may choose to go can be decided by the operator just before he gets to a switch turn-out in the model roadway. It is possible to apply this invention to model car roadways not intended for racing but intended to model highway or city driving. This sort of roadway might be part of a model railroad layout, for example. It is possible to apply this invention to switch turn-outs that have more than a simple "straight-curve" structure. There are switch turn-outs that can direct a train coming in the lead-in leg to go one of three (or more) directions. To operate with turn-outs of this type, many of the common arming, proximity sensing, operation and disarm concepts still apply. The type of additions that might be included in the case of three (or more) way turn-outs might be to allow the common arm signal to be more involved than a simple single arm. For example, an operator might chose among the possible turn-out options at the time of arming by pressing the arm signal more than once.

It is possible that the operator of a layout may want to choose which way a switch should be set (for example: straight, curve-fight, curve-left). One could embody this invention to generate three separate arm signals—one for each possible choice. Only one would be pressed at a time. As before, the specific turn-out to be selected is chosen by the approaching train. This approach of separate arm signals for right, left and straight (or perhaps straight and curve for 2-way switches) is useful on layouts that have both two and three way switches since it allows the operator to select his direction without knowing the present setting of his turn-outs. He simply requests to go right, left or straight. If the turn-out is already set in the desired direction, it does not toggle but does send out a common disarm signal to all turn-outs connected to the common bus. Thus, this invention can be embodied with many different possible arming methods. There may be only a single common arm signal. There may be several common arm signals, one of which is chosen based on its purpose. Yet, the basics of the invention apply: common arming, selection of one or one-of-many objects by the proximity of a moving object, operation of the selected object (either automatically, or by further signaling), common disarming.

It is possible to have each turn-out have a default direction it will switch to if it becomes newly occupied after arming. This "default arm direction" could be set manually, electronically with specific commands or can be learned by each turn-out as the train goes on a "learn mode" run around the layout. It is possible to use an arm command that arms the default, unless the operator wishes to override the default arming by indicating alternative arming such as switch to the opposite of default. In the case of 3-way switches that have a curve left and curve right, the alternative to a "straight" default might be: "arm to switch curve-fight" or"arm to switch curve left". The possibilities here are very many when one begins using more complex common arm signals, more complex turn-out designs, allows "default arm switch directions", allows default arm overriding, and allows turn-out learning of defaults While, in most cases shown in this specification, the occupancy detectors for a given turn-out are shown integrally located at (or perhaps within) the turn-out itself, it is possible to use occupancy detectors that are remotely located from the turn-out itself. In fact, it is possible to use the occupancy detectors from an adjacent turn-out to indicate occupancy on the turn-out in question. This is especially useful when turn-outs are connected directly to one another (i.e. no regular track in between them). Minor accommodation in the electronics needs to be made to allow this, but it seems that this ability will be very useful on some layouts. Basically, it is worth noting that a turn-out's occupancy detectors may actually be located almost anywhere the operator decides he would like them—including on another turn-out or a stand-alone detector located on a regular section of track.

Figure 6:
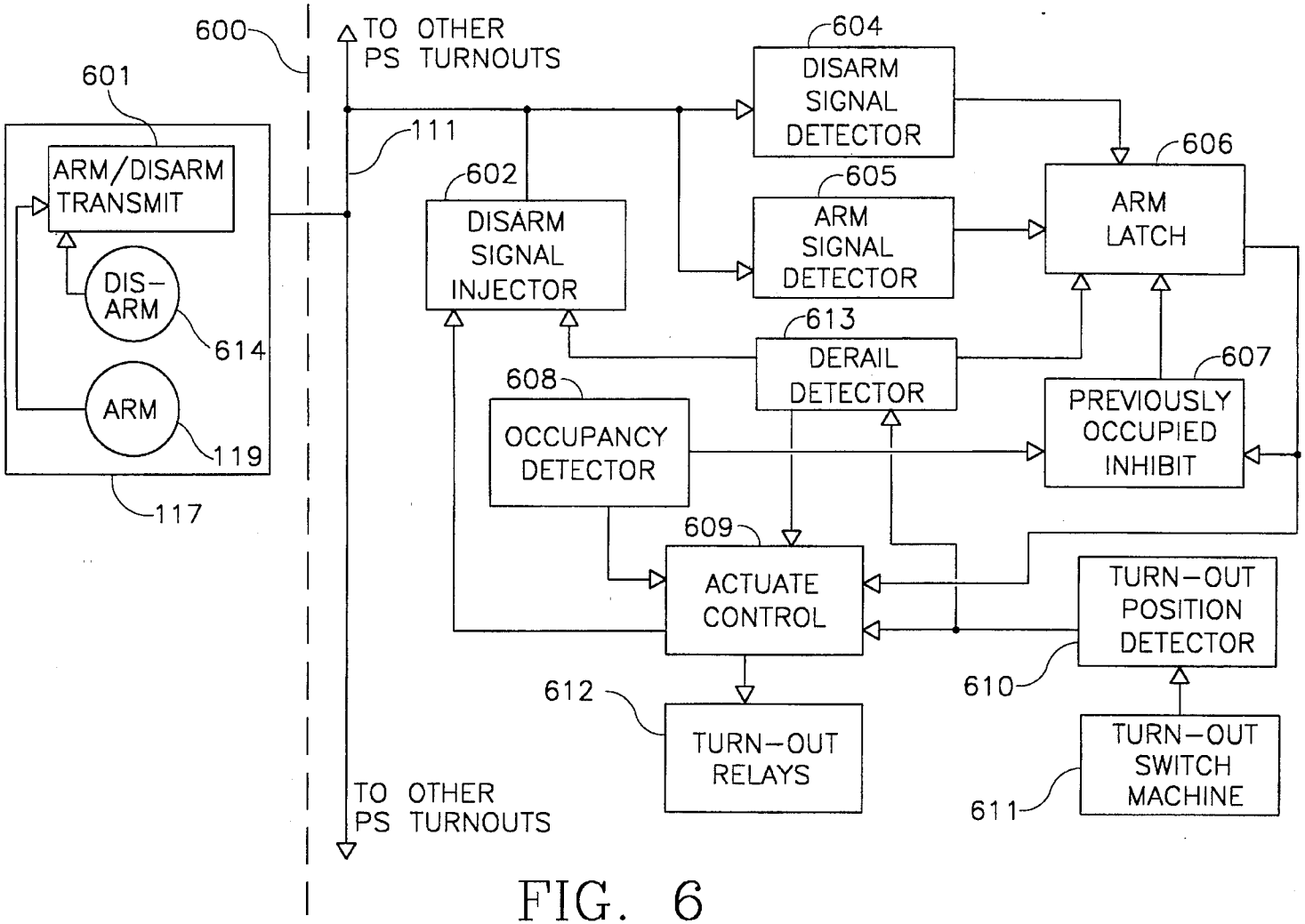
FIG. 6 is a block diagram of the preferred embodiment for turn-outs.

FIG. 6 is a specific example of an embodiment of the present invention. (117 has been redrawn to include DISARM button 614 and ARM/DISARM transmit 601). ARM/DISARM TRANSMIT, 601, consists of an operator interface which permits the operator to request that he would like to ARM all of the PS-equipped turn-outs on his layout by pressing the common arm control, 119. This might be a stand-alone box with a button on it (e.g. 117), or it might be integrated into a more extensive user interface such as a walk-around radio throttle, or the like. When the user wishes to ARM the PS turn-outs, a button, 119 is pressed which then sends a signal from the PS turn-out controller to the PS turn-outs. This signal from 601 is put onto common bus 111 that connects together all of the PS turn-outs on the layout. The system to the right of 600 represents a local control system which would be found in each of the many PS-equipped turn-outs connected through common bus 111. When an ARM signal has been placed on 111, the ARM SIGNAL DETECTOR, 605 will notice that an ARM request has been made. If the PREVIOUSLY OCCUPIED INHIBIT, 607 circuitry has determined that the turn-out has not been recently occupied from any leg (including DERAIL DETECTOR 613), then the ARM LATCH, 606 will be set to arm. This means that it has been determined that a request to arm has been received and that, not having been recently occupied, the PS control system will set itself to arm in readiness to toggle its turn-out.

Now, with 606 set to arm, if OCCUPANCY DETECTOR, 608 detects the presence of an oncoming train, then 606 and 608 will instruct ACTUATE CONTROL, 609 to activate the appropriate relay in TURN-OUT RELAYS, 612. To determine the correct way to toggle the TURN-OUT POSITION DETECTOR, 610 will sense which way the TURN-OUT SWITCH MACHINE, 611, is presently set. With this determination made, 609 will operate the appropriate turn-out relay in 612. So activated, 611 will actually toggle its position. Once 609 asserts actuation, it also sends a signal to the DISARM SIGNAL INJECTOR, 602, which will, in turn, assert a global disarm signal onto bus 111 which will disarm all of the PS turn-outs on the layout, including itself. Disarming occurs when a DISARM signal is placed on 111 because of DISARM SIGNAL DETECTOR, 604, which detects the request to disarm, and sets the ARM LATCH, 606 to not- armed. Whenever a turn-out is toggled from the lead-in side, it generates a global disarm applied to 111. There is one case where a turn-out will be toggled but will not generate a global disarm. This is described next.

In this embodiment we have included DERAIL DETECTOR 613. This box detects a train entering either the curve or straight leg of the turn-out. Because an armed turn-out will toggle when a train reaches the detector at the lead-in leg, a train that entered either the curve or straight legs of an armed turn-out must be immediately disarmed. In our example, this is shown as a connection between 613 and 606. Also, a turn-out that was toggled as a result of the DERAIL DETECTOR 613 must not inject a global disarm signal (via 602) onto line 111—even though DERAIL DETECTOR 613 does locally disarm the ARM LATCH 606 in the specific turn-out that detected the train in its curve or straight leg—while it was armed. The reason for this is that turn-outs that are entered via the curve or straight leg do not require a decision by the operator regarding toggling. And so, an operator needs to be allowed to pass through these turn-outs in this way without affecting his request to toggle the next turn-out he is approaching from the lead-in leg. This is particularly true when turn-outs are very closely spaced.

The operator may wish to explicitly disarm the PS turn-outs. This can be done by pressing disarm button 614 which will cause ARM/DISARM TRANSMIT 601 to generate a disarm signal on common bus 111.

CIRCUIT DESCRIPTION

Conventional Non-Derailing Switch Turn-Out (Prior Art)

Figure 2:
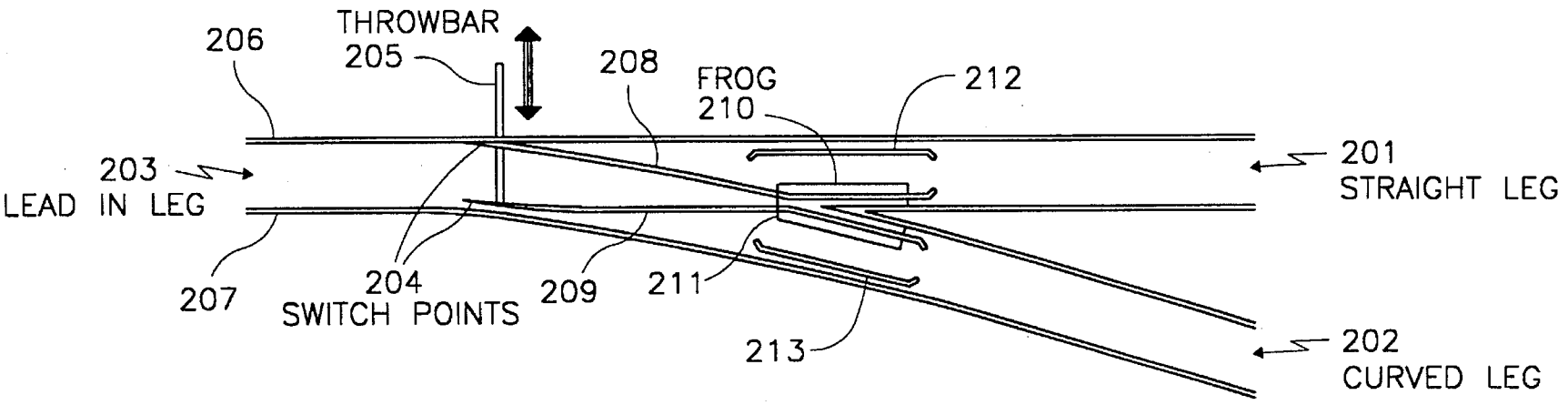
FIG. 2. PRIOR ART
FIG. 2 is a typical turn-out mechanical drawing (prior art)
Figure 3:
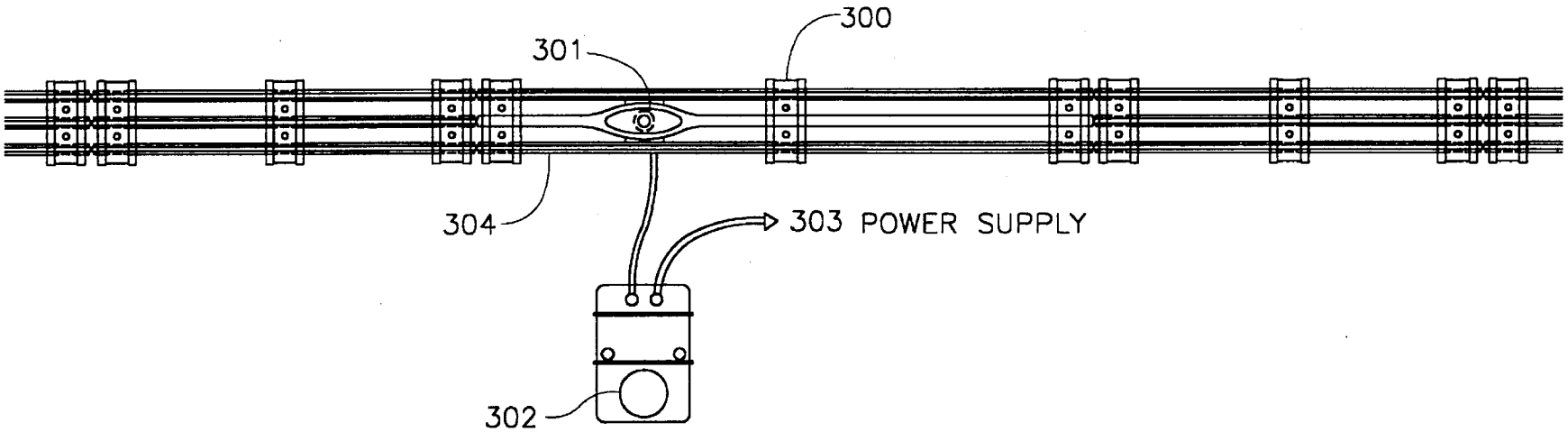
FIG. 3 PRIOR ART
FIG. 3 is a typical uncoupler track mechanical drawing (prior art)

It will be very helpful to first understand how a conventional switch turn-out operates since it will be incorporated into the new PS turn-out system. As an example, we will examine a wiring diagram for a three-rail conventional non-derailing switch turn-out as shown in FIG. 4. First notice that the conventional design is divided into two sections. The portion to the left of dotted line 400 is the turn-out control portion. This portion can be located either near the turn-out itself, or, as is far more popular, it can be located remotely at the layout control center. The portion to the right of 400 is part of the turn-out switch machine itself. There are two sets of indicator lights to denote which state or position the turn-out is set to. Lamp 401 is green and indicates at the turn-out itself that the turn-out is set to the STRAIGHT position. Lamp 402 is red and indicates at the turn-out itself that the turn-out is set to the CURVE position. Lamp 403 is green and indicates at the turn-out control that the turn-out is set to the STRAIGHT position. Lamp 404 is red and indicates at the turn-out control that the turn-out is set to the CURVE position. The lamp colors described in this example is the popular convention, but operators may choose different colors. Solenoid coils 405, 406 and actuator arm 407 perform the electro-mechanical operation of the turn-out switch machine. 407 is the electrical portion associated with the turn-out switch points (204, FIG. 2). Its position is a response, or result of where the turn-out is actually positioned (straight or curve). It is solenoid coil 405 which, when energized will mechanically push the switch points and therefore 407 into the curve position 409. If solenoid coil 406 is energized, it will mechanically push the switch points and therefore 407 into the straight position 408.

Note that when 407 is in the straight position (i.e. connected to throw position 408), ACC accessory turn-out power, 413, is routed to lamp 401 to turn it on. ACC 413 is also applied through solenoid coil 405 to lamp 403 to turn it on as well. By design, the lamp current that flows through solenoid 405 is not sufficient to activate it (otherwise the circuit would oscillate between curve and straight). Note that when switch 407 is in the curve position (i.e. connected to throw position 409), ACC 413, is routed to lamp 402 to turn it on. ACC 413 is also applied through solenoid coil 406 to lamp 404 to turn it on as well. The lamp current that flows through solenoid 406 is not sufficient to activate it either. Momentary switch turn-out controller 410 causes the turn° out position to toggle. If switch 407 is already in the straight position 408, then moving 410 to the straight position 411 does not do anything. But, when the turn-out position of 410 is moved to the curve position 412, then a circuit is closed on solenoid 405 to ACC accessory turn-out power ground, 418. With solenoid 405 energized, the switch points and actuator arm 407 are pushed into the curve position. In this new position, power to solenoid coil 405 is interrupted. At this point, momentary switch 410 will be returned to its center (off) position by the operator.

With switch 407 now in the curve position, green lamps 401 and 403 will be turned off and red lamps 402 and 404 will be turned on. Now, with the turn-out set to curve, the behavior of the circuit is similar but involves other components. When switch 407 is in the curve position 409, ACC 413, is routed to 402 to turn it on. 413 is also applied through solenoid coil 406 to lamp 404 to turn it on as well. The lamp current that flows through solenoid 406 is not sufficient to activate it. With 407 in the curve position, moving the momentary switch 410 to the curve position 412 does not do anything. But, when the turn-out position of 410 is moved to straight 411, then a circuit is closed on solenoid 406 to ACC ground, 418. With 406 energized, the switch points (204, FIG. 2) and 407 are pushed into the straight position. In this position, the power to 406 is interrupted. In this way, the operator can set the turn° out switch to whichever position he wishes. The particular turn-out is selected by the operator reaching physically for the appropriate turn-out controller 410 and operating by moving the turn-out control to the desired position (either 411 or 412).

Some turn-outs employ a non-derailing mechanism that allows a train that enters either the curve or straight leg to toggle the turn-out to the correct direction to prevent a derailment. In the example in FIG. 4., a momentary switch 414 is shown with the pole connected to ACC ground, 418. When a train enters the straight leg, it causes the switch 414 to move from center off to 415. If a train enters the curve leg, it causes the switch 414 to move from center off to 416. If the turn-out is already in the correct position, the turn out will stay that way. If the turn-out is set in the wrong position, it will toggle to the correct position to align itself with the leg (curve or straight) that is being entered. For three-rail switches, the switch contact points, 415,416 are connected to separate insulated rails on the straight leg and curve leg respectively. Ground connection is made to either the insulated rails by the metal wheels of the train as it passes over the straight leg or curve leg of the turn-out. This connects ACC ground, 418 to 415 or 416, respectively. This will cause the turn-out to toggle in the same way as if switch 410 were moved to 411 or 412. For two-rail turn-outs, more complex detectors are usually installed in the curve and straight leg to activate coils on a relay that will perform the function of 414, 415 and 416. Many turn-outs used in model railroading do not include a non-derailing feature.

Turn-outs for two-rail layouts tend to be different in design, but perform essentially the same function. The point is, that the only operation that can be performed on a switch turn out is to toggle the turn-out setting. This toggling operation itself requires no intelligence. Where the intelligence is needed is in the selection of the particular turn-out and the decision to toggle it as it enters the lead-in leg. For this reason, it is ideal to use the approaching train itself to make the selection, the operator to make the decision to toggle the switch setting, and allow the turn-out to perform the toggling automatically.

With the addition of a few components, it will become clear how to modify this conventional turn-out control system into one that embodies this PS turn-out concept.

PS (Proximity-Selected) Turn-out Control

Figure 5A:
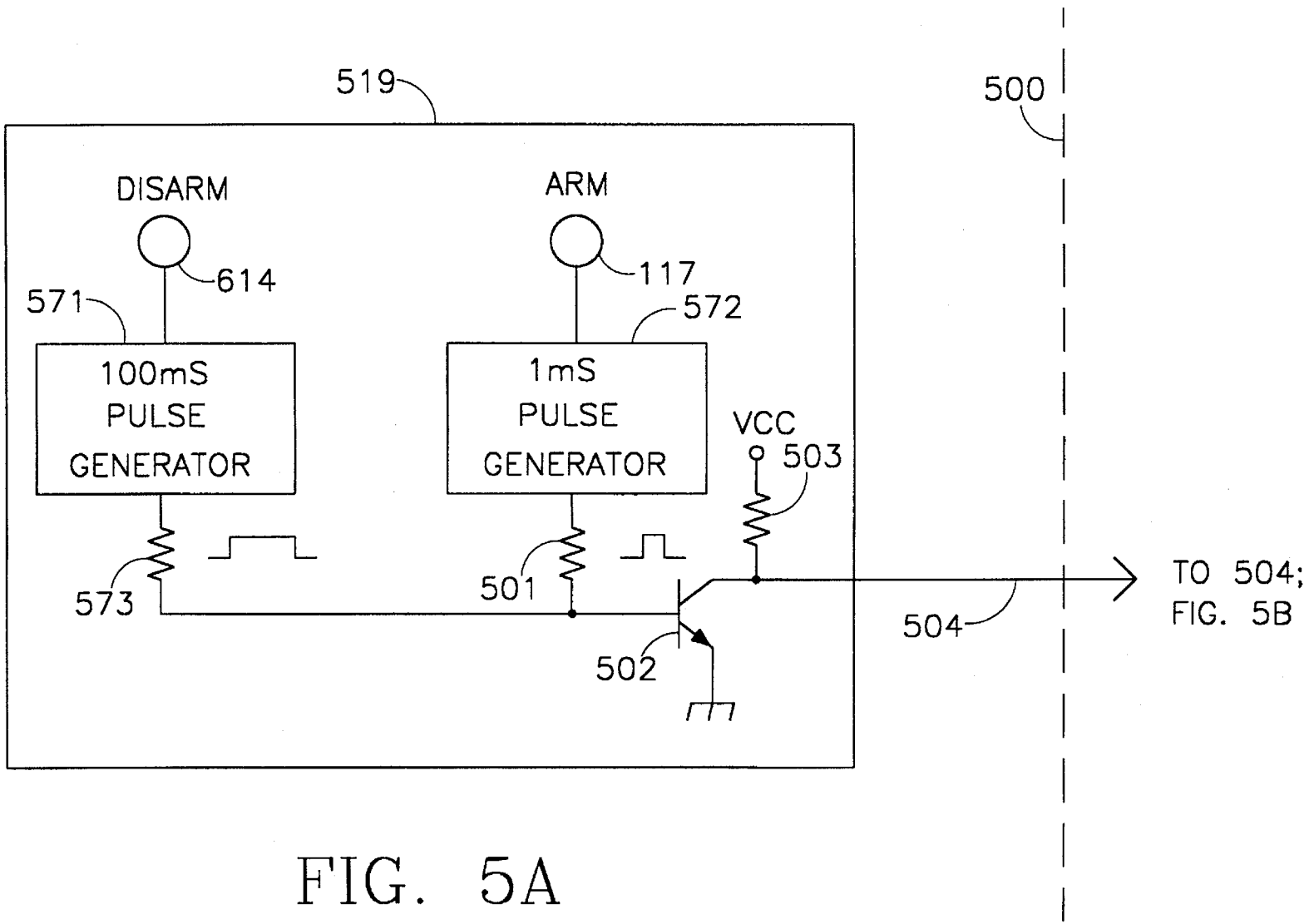
FIG. 5A illustrates arm/disarm transmit signal generation circuitry for the preferred embodiment.
Figure 5B:
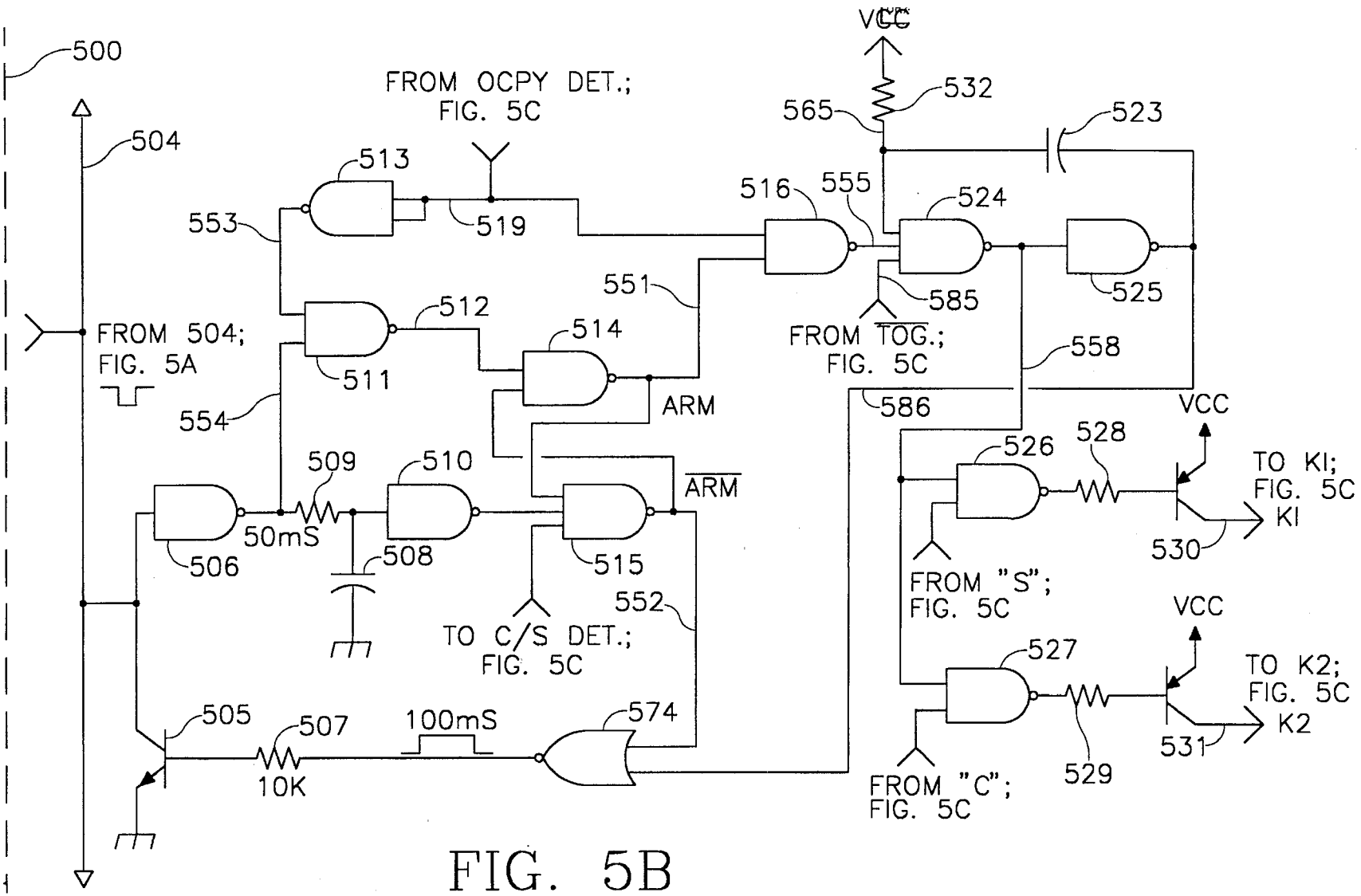
FIG. 5B illustrates arming and actuating circuitry for the preferred embodiment.
Figure 5C:
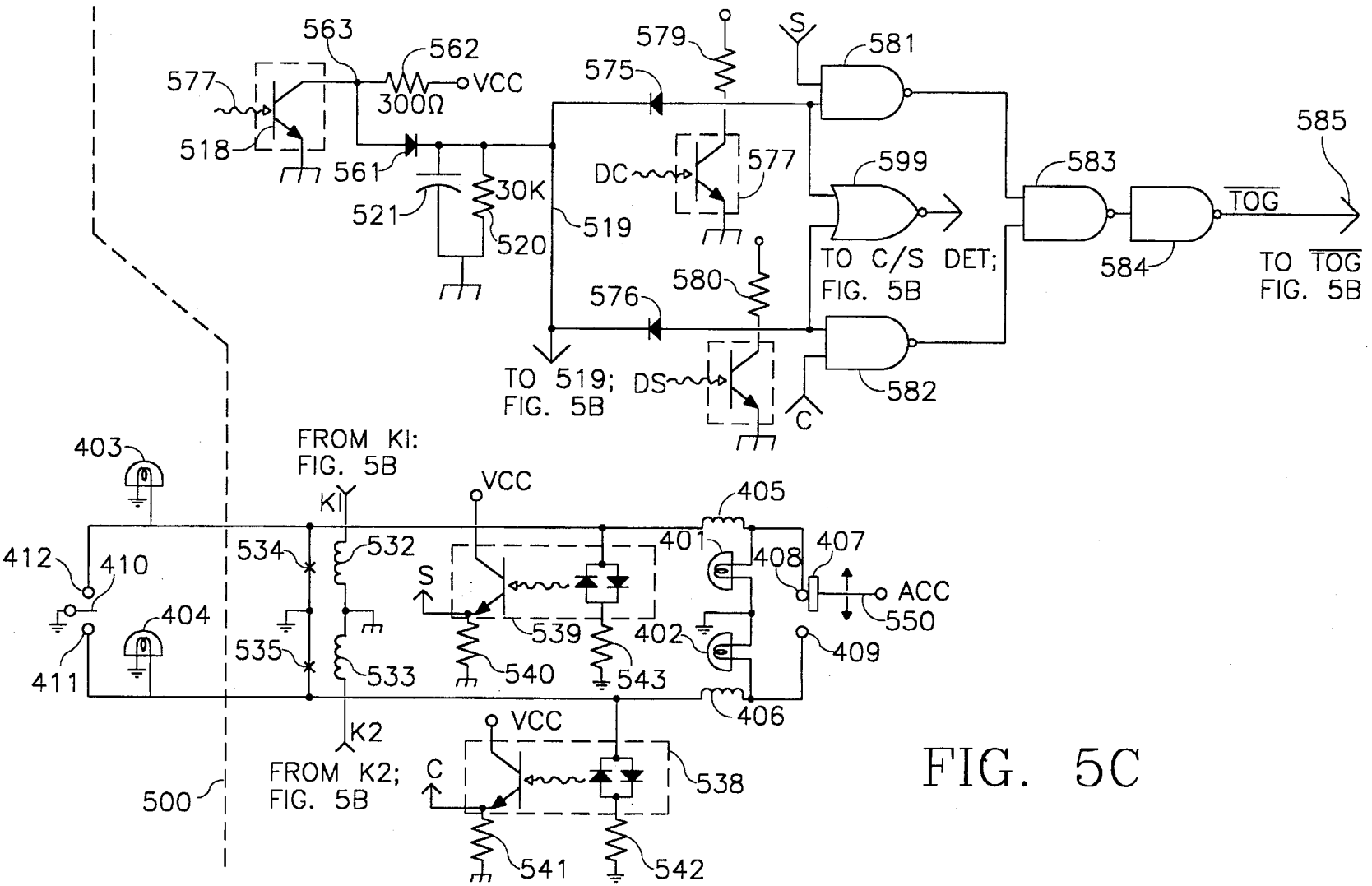
FIG. 5C illustrates detector and de-rail circuitry for the preferred embodiment.

It is possible to implement circuitry to embody this invention in many ways. It is possible to use a microprocessor and software. It is possible to collect the logic for the implementation into a PLD (programmable logic device). It is possible to collect it all into a custom integrated circuit. To encourage the greatest level of understanding of the functioning of this invention, FIGS. 5A–5C show an explicit embodiment of discrete electronics which would function as a PS turn-out control system for three-rail switch turn-outs. The circuitry to the left of dotted line 500 would be enclosed in a "turn-out control" location, similar to 117 shown in FIG. 1 at the layout control center 120. The electronics to the right of 500 is preferably located near each PS turn-out, since the proximity detectors for each turn-out would be located there. The switch machine in FIG. 4 is re-drawn in FIG. 5C. Note, that the turn-out controller consisting of switch 410, 411, 412 and indicator lamps 403 and 404 are located to the left of dotted line 500, at the layout control center 120. The exact location of the electronics is not, in itself, important—but, only serves to help to understand what is probably positioned where. Line 504 is wired common to all of the PS turn-outs. Switch 410 is still connected to the switch machine and is positioned at the layout control center to allow the user to switch his turn-out in the conventional manner should he wish to. This invention does not preclude nor interfere with the use of remote control turn-out controllers.

The circuitry in FIGS. 5A–5C map fairly closely into the block diagram, FIG. 6. Some components have some shared functionality, but a descriptive correspondence will be most helpful. ARM/DISARM TRANSMIT 601 corresponds to: arm button 117, 1 mS pulse generator 572, base resistor 501, collector resistor 503, transistor 502, disarm button 614, 100 mS pulse generator 571, and base resistor 573. DISARM SIGNAL INJECTOR 602 corresponds to: transistor 505, base resistor 507 and output of NOR gate 574. OCCUPANCY DETECTOR 608 corresponds to: opto-transistor 518, pull-up resistor 562, diode 561, and timing circuit made up of resistor 520 and capacitor 521. DISARM SIGNAL DETECTOR 604 corresponds to: inverters 506 and 510, and 50 mS timing circuit consisting of resistor 509 and capacitor 508. ARM SIGNAL DETECTOR 605 corresponds to: inverter 506. ARM LATCH 606 corresponds to: NAND gates 514 and 5 15. PREVIOUSLY OCCUPIED INHIBIT 607 corresponds to: inverter 513 and NAND gate 511. DERAIL DETECTOR 613 corresponds to: diodes 575 and 576, opto-transistors 577 and 578, pull-up resistors 579 and 580, and NAND gates 581,582, 583, 599 and 584. ACTUATE CONTROL 609 corresponds to: NAND gates 516, 524, 525, 526 and 527, base resistors 528 and 529, and transistors 530 and 531 and 100 mS timing circuit consisting of resistor 532 and capacitor 523. TURN-OUT RELAYS 612 corresponds to: relay coils 532 and 533 and normally-open relay contacts 534 and 535. SWITCH MACHINE 611 corresponds to solenoids 405 and 406, lamps 401 and 402, switch consisting of 407, 408 and 409. TURN-OUT POSITION DETECTOR 610 corresponds to: opto-couplers 538 and 539, resistors 540, 541,542 and 543.

DETAILED CIRCUIT DESCRIPTION OF FIGS. 5A–5C:

The process of using the PS turn-outs begins with the operator requesting to ARM the turn-outs by pressing a button, 117, on the turn-out control 5 19. When this occurs, circuitry in the turn-out control 572 will generate a short pulse (perhaps approximately 1 mS long) which is applied to current limit resistor 501. This briefly turns on transistor 502 which pulls down line 504 near ground for 1 mS. Line 504 is one of the signal lines in common bus 111. Line 504 is pulled up to VCC (perhaps 5 V) by pull-up resistor 503. This represents the common ARM signal that is sent to all PS turn-outs via common line 504. When a layout containing PS turn-outs is first powered up, it is important to begin operation with all of the turn-outs explicitly disarmed. It is also generally desirable to provide the operator a way to disarm his PS turn-outs if he wishes to do this. This initialization can be achieved by installing "power-on reset"

circuitry to ensure the 100 mS disarm pulse generator 571 produces a disarm pulse when the PS control system is first powered up. Also, the operator can press disarm control button 614 to cause 571 to put a 100 mS pulse to the base of transistor 502. This action will cause a 100 mS pulse to circuit ground of line 504. This 100 mS signal, it will be shown, will cause all of the PS turn-outs to disarm. Next we will describe how each turn-out reacts to this ARM signal.

First, assume that the turn-out we will describe is currently not armed and is not currently occupied and that it is set to the straight position. Thus, line 519 will be HI (approx. 5 V), line 551 will be LO (approx. 0 V), line 552 will be HI, line S (556) will be HI, line C (557) will be LO. As will be shown, initially both relays 532 and 533 are not energized. With no train present at either the curve or straight legs of the turn-out, line 585 (/TOG) will be HI.

With 551 (output of arm-latch gate 514) LO, 555 is forced HI. Pull-up resistor 522 holds the top input to NAND gate 524 HI. Thus, line 558 is LO and 586 (output of NAND gate 525) is HI. With 586 HI and 552 HI, the output of NOR gate 574 is LO, and so, transistor 505 is "off" and does not interfere with the assertion of the LO pulse which creates the ARM signal. The time constant for resistor 509 and capacitor 508 is much longer than 1 mS (perhaps 50 mS). Because of this, while line 554 pulses HI in response to the ARM signal, the output of 510 simply remains HI when this pulse OCCURS.

With 551 LO, the ARM LATCH (514 & 515) has been holding the "unarmed" status (552=HI, 551=LO). With 519 LO ("unoccupied" turn-out) 553 is HI. Thus 512 pulses LO when the ARM signal (504) pulsed LO. When 512 pulses LO, it will flip the state of the ARM LATCH, causing 551 to go HI and 552 to go LO. The electronics is now armed and waiting to discover if it is the first of all the PS turn-outs sharing the common ARM line (504) to become occupied. So, at this point, 551 is HI, 519 is still LO, 552 is LO. NAND gate 516 is ready and waiting to respond to an occupancy signal.

When occupancy of the lead-in leg of the turn-out occurs, line 519 goes HI. FIG. 5C shows that this might occur through the use of an photo-detector. For example, occupancy can easily be determined by a light beam, 517, that is pointing across the rail and causes photo-transistor 518 to be "on" when the turn-out is un-occupied. 518 "on" causes node 563 to be LO. Diode 561 is "off" and resistor 520 pulls node 519 LO. When a wheel from an approaching train breaks the light beam (517), photo-transistor 518 turns "off" momentarily. Node 563 is pulled HI by 562, diode 561 conducts and charges capacitor 521 HI. The small signal loss of 1 diode and the voltage division of 520 and 562 would not be sufficient to cause a logic family such as CMOS to fail to achieve a logic HI at 519. There are many ways to design an occupancy detector; this is but one design. The key to the operation is that line 519 is LO when un-occupied and goes HI when occupied. To ensure that the detector can indicate that it has been "recently" occupied, node 519 has a fast-charge, slow decay characteristic. Thus, 519 will continue to indicate a HI for about 3 seconds after the photo detector, 518, has quit being pulsed. This occurs because capacitor 521 charges from resistor 562 but discharges through resistor 520. It is diode 561 that causes this.

For reasons described earlier, it is important that occupancies on either the curve or straight leg also cause line 519 to go HI. It is the derail circuitry 575–580 that achieves this. The functioning of this circuitry is completely analogous to the operation of the lead-in leg occupancy detector. If occupancy is detected on either the curve or straight leg, then line (C/S DET) will go LO. If this occurs, then the arm latch (514 & 515) is immediately set to disarm (551 LO, 552 HI). Line 585 (/TOG) also connects to gate 524.

When 519 goes HI and the turn-out has been armed, 555 will go LO, 558 goes HI, and 564 goes LO. Energy from this HI-LO transition is coupled across capacitor 523 which causes 565 to pulse LO until resistor 522 can charge capacitor 523, causing 586 to return HI. Thus, gates 524, 525 and capacitor 523, and resistor 532 form a nonretriggerable one-shot monostable. Line 558 pulses HI for a set interval (perhaps about 100 mS) whenever an armed turn-out becomes occupied, or until line 551 goes LO.

When 558 pulses HI, transistor 530 will pulse "on" causing relay 532 to operate briefly. Transistor 531 does not operate because signal C, 557, is LO and blocks signal 558 from turning on transistor 531. When 532 energizes briefly, it causes normally-open contact 534 to pulse closed. This will cause the turn-out to change its setting from straight to curve in a fashion identical to what was previously described. The opto-isolator circuitry (539, 543, 540, 538, 542, 541) serve to produce logic signals indicating which way the turn-out is set. Opto-isolators are used because the accessory power for the turn-out is quite different and independent from the electronics supply, VCC. Ground return for ACC is 418 which is different than circuit ground. When the turn-out is in the straight position, current flows from accessory power ACC through 405 through the opto-coupler input diodes, through limiting resistor 543 and back to accessory power-ground. Thus, when the turn-out is in the straight position, the opto-isolator 539 is energized and node S (556) is pulled HI. Since no current flows through solenoid coil 406 when the turn-out is set to straight, opto-isolator 538 is not energized and line C (557) is LO. Similarly, when the turn-out is set to curve, S is LO and C is HI. Because of this, it should be clear that when line 558 pulses HI in response to the armed turn-out having become newly occupied, the state of lines S and C will cause the turn-out to toggle to the opposite of whichever way it was set (i.e. toggle).

When 586 pulses HI, transistor 505 pulses on (for about 100 mS), which causes the common input line 504 to pulse LO (for about 100 mS). When this occurs, all of the PS turn-outs attached to line 504 will produce a HI pulse at their respective node 554 that lasts for approximately 100 mS. This 100 mS pulse is long enough to charge capacitor 508 and cause the output of NAND gate 510 to pulse LO (for about 50 mS). When this occurs it causes the state of the ARM LATCH (514, 515) to return to the "disarmed" state (i.e. 551=LO, 552=HI). When 504 goes LO from this global disarm, both lines 512 and the output of NAND gate 510 will be LO. When 504 returns HI, however, the output of NAND gate 510 will stay LO longer than line 512. Thus, the disarming of latch (514, 515) overrides the arming. What has now occurred is that all of the PS turn-outs were armed in common by a LO pulse on line 504. Only the turn-out that was FIRST to become newly occupied toggled the state of its turn-out and then asserted a long LO pulse onto the common ARM/DISARM line, 504, which then disarmed all of the turn-outs (including the one that just toggled its turn-out).

If the presence of a train on either the curve or straight leg is detected, then the electronics consisting of NAND gates 581,582, 583 and 584 will determine whether the turn-out needs to be emergency toggled to prevent a derailment. Opto-transistor 577 pulses off if the occupancy detector on the curve leg (DC) detects the presence of a train at the curve leg. If the turn-out is set to straight (S=HI), then the output of gate 581 will go LO. Likewise, opto-transistor 578 pulses off if the occupancy detector on the straight leg (DS) detects the presence of a train at the straight leg. If the turn-out is set to curve (C=HI), then the output of gate 582 will go LO. If either gate 581 or 582 goes LO, then line 585 (/TOG) will go LO also. If line 585 goes LO then the turn out is forced to toggle. This toggling is achieved by the connection between the output of gate 584 and the input of gate 524. If either 577 or 578 pulse off then the output of NOR 599 will pulse line C/S DET LO which will immediately set the arm latch (514,515) to disarm (551 LO 552 HI). Since the/ARM line 552 was forced HI, NOR gate 574 will block the global disarm signal 586 from reaching transistor 505. Thus, no global disarm will occur when an emergency derailment turn-out toggling is done.

The last action to describe is how the arming operation is inhibited if the turn-out has been recently occupied. "Recently occupied" will be taken to mean within the time frame in which the time constant of resistor 520 and capacitor 521 has continued to hold line 519 HI after the occupancy-detection means has caused it to initially go HI. If the turn-out has, in fact, been recently occupied then line 519 is HI and 553 is LO. Note that NAND gate 511 is connected as to perform an arm-inhibit function. That is, with 553 LO, signal 554 will not be passed through gate 511. In this way, the PS electronics will inhibit becoming armed if it has been recently occupied on any of the legs of the turn-out.

Having illustrated and described the principles of my invention in a preferred embodiment thereof, it should be readily apparent to those skilled in the art that the invention can be modified in arrangement and detail without departing from such principles. We claim all modifications coming within the spirit and scope of the accompanying claims.

We claim:

1. In a model railroad layout, an automatic method of controlling one or more turn-outs comprising the steps of:

arming the one or more turn-outs so as to enable them to toggle; and for each turn-out:

determining electronically whether or not the turn-out is occupied by a train;

electronically detecting a train approaching the turn-out; and if the turn-out is not occupied by a train, automatically toggling the turn-out in response to the train approaching the turn-out without operator intervention;

and then disarming all of the turn-outs so that only the first unoccupied turn-out approached by the train is toggled.

2. An automatic turn-out apparatus for a model railroad layout comprising:

a lead-in leg;

a curve leg;

a straight leg;

electric switch means for coupling one at a time of the curve leg and the straight leg to the lead-in leg;

electronic detection means for detecting and indicating a train approaching the turn-out;

means for arming the turn-out; and means for automatically toggling the switch means in response to said indication of a train approaching the turn-out only if the turn-out is armed.

3. An automatic turn-out apparatus according to claim 2 further comprising:

occupancy means for detecting and indicating a train occupying the turn-out; and means for disarming the turn-out responsive to the indication of a train occupying the turn-out so that the turn-out cannot toggle while it is occupied.

4. An automatic turn-out apparatus according to claim 2 further comprising:

means for coupling the turn-out apparatus to a second turn-out apparatus; and wherein the means for arming the turn-out apparatus includes common arming means for arming both the first and second turn-out apparatus.

5. A turn-out control system for use in a model train layout having a plurality of turn-outs, the control system comprising:

a plurality of detection means for detecting the presence of a model train, each of the detection means being located at a respective location on the layout adjacent a corresponding one of the turn-outs;

arming request means for arming all of the turn-outs;

means in each of the turn-outs for automatically toggling in response to the indication of the presence of the train at the corresponding location of the layout only if the turn-out is armed; and disarming means for disarming all of the previously armed turn-outs in the layout when one of the turn-outs toggles.

6. A turn-out control system according to claim 5 wherein the arming means is arranged for substantially simultaneously arming all of the turn-outs.

7. A turn-out control system according to claim 5 wherein the arming means includes an arming switch for operation by an operator.

8. A turn-out control system according to claim 5 wherein the arming means includes means for remote control by an operator so that the operator can effect turn-out control without directly toggling any of the turn-outs.

9. A turn-out control system according to claim 5 further comprising means disposed in each of the turn-outs for preventing arming of the turn-out when the corresponding detection means indicates the presence of a model train at said respective location on the layout adjacent the turn-out, thereby preventing arming of all turn-outs that a train is already occupying.

10. In a model railroad layout, an automatic method of controlling a plurality of uncoupler tracks from a single uncouple control switch, the method comprising the steps of:

providing a single uncouple control switch arranged for actuating any selected one at a time of the plurality of uncoupler tracks;

while the model railroad layout is in operation, determining electronically whether or not each uncoupler track is occupied by a train;

substantially simultaneously arming all of the uncoupler tracks except for those uncoupler tracks determined to be occupied by a train;

for each armed uncoupler track:

detecting a train approaching the armed uncoupler track; and selecting only the armed uncoupler track in the path of the approaching train so as to enable the selected uncoupler track to be actuated in response to actuation of the uncouple control switch;

disarming all of the uncoupler tracks except the selected uncoupler track so that only the first unoccupied uncoupler track approached by the train after said arming step is selected; and then actuating only the selected uncoupler track in response to operator actuation of the uncouple control switch for uncoupling a railroad car located on the selected track without manual selection, whereby the uncoupler track is effectively selected by the approaching train but not operated until the operator actuates the uncouple control switch.

11. A method according to claim 10 further comprising automatically disarming the selected uncoupler track after actuation in response to the uncoupling.

12. A method according to claim 10 wherein said disarming step includes transmitting a disarm signal from the selected uncoupler track to all of the other uncoupler tracks.

13. A method according to claim 12 wherein said transmitting a disarm signal is effected when the selected uncoupler track becomes occupied by the approaching train.

14. A method according to claim 10 wherein said arming step is effected in response to a first operator actuation of the uncouple control switch, and said actuating the selected uncoupler track is effected in response to a second operator actuation of the uncouple control switch.

15. A method according to claim 10 further comprising disarming the selected uncoupler track in response to continuous actuation of the uncouple control switch exceeding a predetermined minimum disarm time.

16. In a model railroad layout, an automatic method of controlling a plurality of operating accessories from a common control switch, each operating accessory being associated with a corresponding section of track, and the method comprising the steps of:

providing a common control switch for actuating the operating accessories;

substantially simultaneously arming all of the operating accessories so as to enable them to be selected;

for each operating accessory:

determining electronically whether or not the corresponding track section is occupied by a train;

electronically detecting a train approaching the corresponding track section; and if the corresponding track section is not occupied by a train, selecting the accessory in response to the train approaching the corresponding track section;

disarming all of the other accessories so that only the accessory associated with the first unoccupied corresponding track section approached by the train is selected; and actuating only the selected accessory in response to user-actuation of the common control switch.

* * * * *